US011103028B2

(12) United States Patent
Bruce et al.

(10) Patent No.: US 11,103,028 B2
(45) Date of Patent: Aug. 31, 2021

(54) MULTI-LAYERED BRAIDED ARTICLE AND METHOD OF MAKING

(71) Applicant: NIKE, Inc., Beaverton, OR (US)

(72) Inventors: Robert M. Bruce, Portland, OR (US); Eun Kyung Lee, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/820,822

(22) Filed: Aug. 7, 2015

(65) Prior Publication Data

US 2017/0035149 A1 Feb. 9, 2017

(51) Int. Cl.

| | |
|---|---|
| ***A43B 1/04*** | (2006.01) |
| ***A43B 23/02*** | (2006.01) |
| ***D04C 3/38*** | (2006.01) |
| ***D04C 3/40*** | (2006.01) |
| ***D04C 1/08*** | (2006.01) |
| ***D04C 3/08*** | (2006.01) |

(52) U.S. Cl.

CPC ..... *A43B 23/0245* (2013.01); *A43B 1/04* (2013.01); *A43B 23/0205* (2013.01); *D04C 1/08* (2013.01); *D04C 3/08* (2013.01); *D04C 3/38* (2013.01); *D04C 3/40* (2013.01); *A43B 23/024* (2013.01); *A43B 23/0255* (2013.01); *D10B 2403/023* (2013.01); *D10B 2501/043* (2013.01)

(58) Field of Classification Search

CPC ... A43B 23/0245; A43B 1/04; A43B 23/0205; A43B 23/0235; A43B 23/0295; D04C 3/00; D04C 3/40; D04C 3/38

See application file for complete search history.

(56) References Cited

U.S. PATENT DOCUMENTS

| | | | |
|---|---|---|---|
| 165,941 | A | 7/1875 | Malhere |
| 329,739 | A | 11/1885 | Henkels |
| 376,372 | A | 1/1888 | Dodge et al. |
| 509,241 | A | 11/1893 | Packard |
| 586,137 | A | 7/1897 | Medger |
| 621,922 | A | 3/1899 | Kelsall |
| 972,718 | A | 10/1910 | Rahm |
| 1,182,325 | A | 5/1916 | Vinco |
| 1,318,888 | A | 10/1919 | Carpentier |
| 1,527,344 | A | 2/1925 | Bente et al. |
| 1,538,160 | A | 5/1925 | Bosebeck |

(Continued)

FOREIGN PATENT DOCUMENTS

| | | | |
|---|---|---|---|
| BE | 426458 | A1 | 3/1938 |
| CN | 86209002 | B | 10/1987 |

(Continued)

OTHER PUBLICATIONS

International Search Report and Written Opinion dated Jan. 12, 2017 in International Patent Application No. PCT/US2016/045313, 15 pages.

(Continued)

*Primary Examiner* — Katharine G Kane

(74) *Attorney, Agent, or Firm* — Shook, Hardy and Bacon LLP

(57) ABSTRACT

An article includes a two layered braided upper assembly with an outer braided structure and an inner braided structure. The braided structures may have different braid patterns. The dual layered upper assembly can be manufactured using a braid machine with multiple rings of spools.

15 Claims, 21 Drawing Sheets

(56) References Cited

U.S. PATENT DOCUMENTS 1,540,903 A 6/1925 Santoyo
1,554,325 A 9/1925 Bente
1,583,273 A 5/1926 Bosebeck
1,597,934 A 8/1926 Stimpson
1,600,621 A 9/1926 Buek, Jr.
1,622,021 A 3/1927 Birkin et al.
1,637,716 A 8/1927 Turck
1,663,319 A 3/1928 Snell
1,687,643 A 10/1928 Berliner
1,713,307 A 5/1929 Stritter
1,717,183 A 6/1929 Brenner
1,730,768 A 10/1929 Heyman
1,803,554 A 5/1931 Knilans
1,828,320 A 10/1931 Daniels
1,832,691 A 11/1931 David
1,864,254 A 6/1932 Meyer
1,877,080 A 9/1932 Teshima
1,887,643 A 11/1932 Huber
1,949,318 A 2/1934 Markowsky
D91,999 S 4/1934 Heilbrunn
2,001,293 A 5/1935 Wilson
2,022,350 A 11/1935 Huber
2,091,215 A 8/1937 Price
2,144,689 A 1/1939 Roberts
2,147,197 A 2/1939 Glidden
2,161,472 A 6/1939 Hurwit
2,162,472 A 6/1939 Scharf
2,165,092 A 7/1939 Daniels
2,188,640 A 1/1940 Bloch et al.
RE21,392 E 3/1940 Hurwit
2,271,888 A 2/1942 Manley
2,311,959 A 2/1943 Nurk
D137,767 S 4/1944 Goldstein
2,382,559 A 8/1945 Goldstein
2,412,808 A 12/1946 Goldstein
2,521,072 A 9/1950 Lovell
D164,847 S 10/1951 Dronoff
2,586,045 A 2/1952 Hoza
2,617,129 A 11/1952 Petze
2,641,004 A 6/1953 Whiting et al.
2,675,631 A 4/1954 Doughty
2,679,117 A 5/1954 Reed
2,701,887 A 2/1955 Nolan
2,936,670 A 5/1960 Walter
3,052,904 A 9/1962 Reid et al.
3,081,368 A 3/1963 Erich
3,257,677 A 6/1966 Batchelder et al.
3,282,757 A 11/1966 Brussee
3,397,847 A 8/1968 Thaden
3,474,478 A 10/1969 Batchelder et al.
3,504,450 A 4/1970 White
3,525,110 A 8/1970 Rubico
3,586,058 A 6/1971 Ahrens et al.
3,619,838 A 11/1971 Winkler
3,714,862 A 2/1973 Berger
3,745,600 A 7/1973 Rubico et al.
3,805,667 A 4/1974 Orser
3,821,827 A 7/1974 Nadler
3,866,512 A 2/1975 Berger
4,134,955 A 1/1979 Hanrahan, Jr. et al.
4,149,249 A 4/1979 Pavkovich
4,194,249 A 3/1980 Thorneburg
4,222,183 A 9/1980 Haddox
4,232,458 A 11/1980 Bartels
4,275,638 A 6/1981 DeYoung
4,341,097 A 7/1982 Cassidy et al.
4,351,889 A 9/1982 Sundberg
4,394,803 A 7/1983 Goldstein
4,430,811 A 2/1984 Okada
4,447,967 A 5/1984 Luigi
4,519,290 A 5/1985 Inman et al.
4,587,749 A 5/1986 Berlese
4,591,155 A 5/1986 Adachi
4,629,650 A 12/1986 Kataoka
4,640,027 A 2/1987 Berlese
4,662,088 A 5/1987 Autry et al.
4,719,837 A 1/1988 McConnell et al.
4,785,558 A 11/1988 Shiomura
4,800,796 A 1/1989 Vendramini
4,847,063 A 6/1989 Smith
4,848,745 A 7/1989 Bohannan et al.
4,857,124 A 8/1989 Shobert et al.
4,879,778 A 11/1989 Becka et al.
4,882,848 A 11/1989 Breyer et al.
4,885,973 A 12/1989 Spain
4,916,997 A 4/1990 Spain
4,919,388 A 4/1990 Hiroyuki et al.
4,939,805 A 7/1990 Walega
4,974,275 A 12/1990 Backes et al.
4,976,812 A 12/1990 McConnell et al.
4,992,313 A 2/1991 Shobert et al.
5,001,961 A 3/1991 Spain
D315,823 S 4/1991 Signori
5,067,525 A 11/1991 Tsuzuki et al.
5,121,329 A 6/1992 Crump et al.
5,201,952 A 4/1993 Yahagi et al.
5,203,249 A 4/1993 Adams et al.
5,257,571 A 11/1993 Richardson
5,287,790 A 2/1994 Akiyama et al.
5,335,517 A 8/1994 Throneburg et al.
5,344,315 A 9/1994 Hanson
5,345,638 A 9/1994 Nishida
5,348,056 A 9/1994 Tsuzuki
5,361,674 A 11/1994 Akiyama et al.
5,381,610 A 1/1995 Hanson
5,385,077 A 1/1995 Akiyama et al.
5,388,497 A 2/1995 Akiyama et al.
5,396,829 A 3/1995 Akiyama et al.
5,398,586 A 3/1995 Akiyama et al.
5,439,215 A 8/1995 Ratchford
5,476,027 A 12/1995 Uchida et al.
5,647,150 A 7/1997 Mariarosa et al.
5,732,413 A 3/1998 Williams
5,792,093 A 8/1998 Tanaka
5,885,622 A 3/1999 Daley
5,896,758 A 4/1999 Moshe et al.
6,024,005 A 2/2000 Uozumi
6,029,376 A * 2/2000 Cass ..... A43C 1/04 36/50.1
6,205,683 B1 3/2001 Clark et al.
6,298,582 B1 10/2001 Friton et al.
6,308,536 B2 10/2001 Roell
6,345,598 B1 2/2002 Bogdanovich et al.
6,401,364 B1 6/2002 Burt
6,451,046 B1 9/2002 Leo et al.
6,482,492 B1 11/2002 Hung
6,510,961 B1 1/2003 Head et al.
6,588,237 B2 7/2003 Cole et al.
6,679,152 B1 1/2004 Head et al.
6,696,001 B1 2/2004 Quddus
6,826,853 B1 12/2004 Zanatta
6,901,632 B2 6/2005 Ryan
6,910,288 B2 6/2005 Dua
6,931,762 B1 8/2005 Dua
6,945,153 B2 9/2005 Knudsen et al.
6,971,252 B2 12/2005 Therin et al.
7,004,967 B2 2/2006 Chouinard et al.
7,047,668 B2 5/2006 Burris et al.
7,093,527 B2 8/2006 Rapaport et al.
7,168,951 B2 1/2007 Fischer et al.
7,204,903 B2 4/2007 Yasui
7,228,777 B2 6/2007 Morissette et al.
7,252,028 B2 8/2007 Bechtold et al.
7,262,353 B2 8/2007 Bartholomew et al.
7,275,471 B2 10/2007 Nishri et al.
7,293,371 B2 11/2007 Aveni
7,300,014 B2 11/2007 Allen
7,347,011 B2 * 3/2008 Dua ..... A43B 1/04 36/10
D578,294 S 10/2008 Mervar et al.
7,430,818 B2 10/2008 Valat et al.
7,444,916 B2 11/2008 Hirukawa
7,549,185 B2 6/2009 Fang
7,566,376 B2 7/2009 Matsuoka

(56) References Cited

U.S. PATENT DOCUMENTS 7,703,218 B2 4/2010 Burgess
7,703,220 B2 4/2010 Aveni
7,793,434 B2 9/2010 Sokolowski et al.
7,793,576 B2 9/2010 Head et al.
7,815,141 B2 10/2010 Uozumi et al.
7,836,608 B2 11/2010 Greene
7,870,681 B2 1/2011 Meschter
7,908,956 B2 3/2011 Dow et al.
7,913,426 B2 3/2011 Valat et al.
7,938,853 B2 5/2011 Chouinard et al.
7,941,942 B2 5/2011 Hooper et al.
7,963,747 B2 6/2011 Cairo
8,006,601 B2 8/2011 Inazawa et al.
8,051,585 B2 11/2011 Hope et al.
8,056,173 B2 11/2011 RongBo
8,061,253 B2 11/2011 Wybrow
8,210,086 B2 7/2012 Head et al.
8,261,648 B1 9/2012 Marchand et al.
8,266,827 B2 * 9/2012 Dojan ..... A43B 23/025 36/45
8,312,645 B2 11/2012 Dojan et al.
8,312,646 B2 11/2012 Meschter et al.
8,388,791 B2 3/2013 Dojan et al.
8,394,222 B2 3/2013 Rettig
8,438,757 B2 5/2013 Roser
8,511,214 B2 8/2013 Gries
8,544,197 B2 10/2013 Spanks et al.
8,544,199 B1 10/2013 Pentland
8,578,534 B2 11/2013 Langvin et al.
8,578,632 B2 11/2013 Bell et al.
8,651,007 B2 2/2014 Adams
8,690,962 B2 4/2014 Dignam et al.
8,757,038 B2 6/2014 Siegismund
8,770,081 B2 7/2014 David et al.
8,789,295 B2 7/2014 Burch et al.
8,789,452 B1 7/2014 Janardhan et al.
8,794,118 B2 8/2014 Dow et al.
8,819,963 B2 9/2014 Dojan et al.
8,959,959 B1 2/2015 Podhajny
8,984,776 B2 3/2015 Ludemann et al.
8,997,529 B1 4/2015 Podhajny
D737,561 S 9/2015 Aveni et al.
9,179,739 B2 11/2015 Bell et al.
D769,590 S 10/2016 Aveni et al.
9,668,544 B2 6/2017 Bruce et al.
9,681,708 B2 6/2017 Greene et al.
9,723,895 B2 8/2017 Schaefer et al.
9,756,901 B2 9/2017 Musho et al.
D798,565 S 10/2017 Aveni et al.
9,839,253 B2 12/2017 Bruce et al.
10,159,297 B2 12/2018 Jamison
10,238,176 B2 3/2019 Bruce et al.
10,280,538 B2 5/2019 Bruce et al.
10,299,544 B2 5/2019 Bruce et al.
10,631,594 B2 4/2020 Boucher et al.
10,709,204 B2 7/2020 Iuchi et al.
10,952,490 B2 3/2021 Bruce et al.
2001/0007180 A1 7/2001 Bordin et al.
2003/0000111 A1 1/2003 Basso
2003/0213547 A1 11/2003 Ono et al.
2004/0118018 A1 6/2004 Dua
2004/0244412 A1 12/2004 Trinh et al.
2005/0076536 A1 4/2005 Hatfield et al.
2005/0081402 A1 4/2005 Orei et al.
2005/0115284 A1 6/2005 Dua
2005/0178026 A1 8/2005 Friton
2005/0193592 A1 9/2005 Dua et al.
2005/0208860 A1 9/2005 Baron et al.
2005/0284002 A1 12/2005 Aveni
2006/0048413 A1 3/2006 Sokolowski et al.
2006/0059715 A1 3/2006 Aveni
2006/0162190 A1 7/2006 Nishiwaki et al.
2006/0247566 A1 11/2006 Gobet et al.
2006/0260365 A1 11/2006 Miyamoto
2006/0265908 A1 11/2006 Palmer et al.
2006/0283042 A1 12/2006 Greene et al.
2006/0283048 A1 12/2006 Lebo
2007/0022627 A1 2/2007 Sokolowski et al.
2007/0062067 A1 3/2007 Covatch
2007/0101615 A1 5/2007 Munns
2007/0101616 A1 5/2007 Munns
2007/0180730 A1 8/2007 Greene et al.
2007/0245595 A1 10/2007 Chen et al.
2007/0271821 A1 11/2007 Meschter
2007/0271822 A1 11/2007 Meschter
2008/0005930 A1 1/2008 Skirrow
2008/0022553 A1 1/2008 McDonald et al.
2008/0078103 A1 4/2008 Liles
2008/0110048 A1 5/2008 Dua et al.
2008/0110049 A1 * 5/2008 Sokolowski ..... D04B 1/22 36/50.1
2008/0250668 A1 10/2008 Marvin et al.
2009/0126081 A1 5/2009 Lambertz
2009/0126225 A1 5/2009 Jarvis
2009/0126823 A1 5/2009 Yengkhom
2009/0193961 A1 8/2009 Jensen et al.
2009/0241374 A1 10/2009 Sato et al.
2009/0306762 A1 12/2009 McCullagh et al.
2010/0018075 A1 1/2010 Meschter et al.
2010/0043253 A1 2/2010 Dojan et al.
2010/0095556 A1 4/2010 Jarvis
2010/0095557 A1 4/2010 Jarvis
2010/0107442 A1 5/2010 Hope et al.
2010/0139057 A1 6/2010 Soderberg et al.
2010/0154256 A1 * 6/2010 Dua ..... A43B 1/04 36/25 R
2010/0175276 A1 7/2010 Dojan et al.
2010/0199520 A1 8/2010 Dua et al.
2010/0251491 A1 10/2010 Dojan et al.
2010/0251564 A1 10/2010 Meschter
2010/0319215 A1 12/2010 Roser
2011/0041359 A1 2/2011 Dojan et al.
2011/0067271 A1 3/2011 Foxen et al.
2011/0078921 A1 4/2011 Greene et al.
2011/0088285 A1 4/2011 Dojan et al.
2011/0094127 A1 4/2011 Dana, III
2011/0146104 A1 6/2011 Lafortune
2011/0239486 A1 10/2011 Berger et al.
2011/0266384 A1 11/2011 Goodman et al.
2012/0011744 A1 1/2012 Bell et al.
2012/0023786 A1 2/2012 Dojan
2012/0030965 A1 2/2012 Greene et al.
2012/0055044 A1 3/2012 Dojan et al.
2012/0066931 A1 3/2012 Dojan et al.
2012/0096742 A1 4/2012 Shim
2012/0100778 A1 4/2012 Cho
2012/0117826 A1 5/2012 Jarvis
2012/0144698 A1 6/2012 McDowell
2012/0159813 A1 6/2012 Dua et al.
2012/0180195 A1 7/2012 Shull et al.
2012/0186102 A1 7/2012 Lee et al.
2012/0198730 A1 8/2012 Burch et al.
2012/0233882 A1 * 9/2012 Huffa ..... A43B 1/04 36/45
2012/0234052 A1 * 9/2012 Huffa ..... D04B 1/123 66/64
2012/0240429 A1 9/2012 Sokolowski et al.
2012/0246973 A1 10/2012 Dua
2012/0255201 A1 10/2012 Little
2012/0279260 A1 11/2012 Dua et al.
2012/0291314 A1 11/2012 Sokolowski et al.
2012/0297643 A1 11/2012 Shaffer et al.
2013/0019500 A1 * 1/2013 Greene ..... A43B 13/223 36/50.1
2013/0025157 A1 1/2013 Wan et al.
2013/0055590 A1 3/2013 Mokos
2013/0081307 A1 4/2013 del Biondi et al.
2013/0125420 A1 5/2013 Raghuprasad
2013/0152424 A1 6/2013 Dojan
2013/0174446 A1 7/2013 Antonelli et al.
2013/0211492 A1 8/2013 Schneider et al.
2013/0219636 A1 8/2013 Dojan et al.
2013/0239438 A1 9/2013 Dua et al.
2013/0255103 A1 10/2013 Dua et al.

(56) References Cited

U.S. PATENT DOCUMENTS

| | | | |
|---|---|---|---|
| 2013/0260104 | A1 | 10/2013 | Dua et al. |
| 2013/0260629 | A1 | 10/2013 | Dua et al. |
| 2013/0269159 | A1 | 10/2013 | Robitaille et al. |
| 2013/0269209 | A1 | 10/2013 | Lang et al. |
| 2013/0269212 | A1 | 10/2013 | Little |
| 2013/0291293 | A1 | 11/2013 | Jessiman et al. |
| 2013/0304232 | A1 | 11/2013 | Gries |
| 2013/0305465 | A1 | 11/2013 | Siegismund |
| 2013/0305911 | A1 | 11/2013 | Masson et al. |
| 2013/0312284 | A1 | 11/2013 | Berend et al. |
| 2014/0000043 | A1 | 1/2014 | Boardman et al. |
| 2014/0007458 | A1 | 1/2014 | Berger et al. |
| 2014/0020191 | A1 | 1/2014 | Jones et al. |
| 2014/0020192 | A1 | 1/2014 | Jones et al. |
| 2014/0068838 | A1 | 3/2014 | Beers et al. |
| 2014/0070042 | A1 | 3/2014 | Beers et al. |
| 2014/0082905 | A1 | 3/2014 | Wen |
| 2014/0088688 | A1 | 3/2014 | Lilburn et al. |
| 2014/0109441 | A1 | 4/2014 | Mcdowell et al. |
| 2014/0130372 | A1 | 5/2014 | Aveni et al. |
| 2014/0134405 | A1 | 5/2014 | Sung-Yun |
| 2014/0137433 | A1 | 5/2014 | Craig |
| 2014/0137434 | A1* | 5/2014 | Craig ..... A43B 1/04 36/54 |
| 2014/0150292 | A1 | 6/2014 | Podhajny et al. |
| 2014/0173932 | A1 | 6/2014 | Bell |
| 2014/0173934 | A1 | 6/2014 | Bell |
| 2014/0173935 | A1 | 6/2014 | Sabbioni |
| 2014/0182447 | A1 | 7/2014 | Kang et al. |
| 2014/0189964 | A1 | 7/2014 | Wen et al. |
| 2014/0196316 | A1 | 7/2014 | Follet |
| 2014/0215850 | A1 | 8/2014 | Redl et al. |
| 2014/0237854 | A1 | 8/2014 | Fallon |
| 2014/0237858 | A1 | 8/2014 | Adami et al. |
| 2014/0245633 | A1 | 9/2014 | Podhajny |
| 2014/0259760 | A1 | 9/2014 | Dojan et al. |
| 2014/0310983 | A1 | 10/2014 | Tamm et al. |
| 2014/0310984 | A1 | 10/2014 | Tamm et al. |
| 2014/0310986 | A1 | 10/2014 | Tamm et al. |
| 2014/0310987 | A1 | 10/2014 | Sokolowski et al. |
| 2014/0338222 | A1 | 11/2014 | Song |
| 2014/0352173 | A1 | 12/2014 | Bell et al. |
| 2014/0373389 | A1 | 12/2014 | Bruce |
| 2014/0377488 | A1 | 12/2014 | Jamison |
| 2015/0007451 | A1 | 1/2015 | Bruce |
| 2015/0013187 | A1 | 1/2015 | Taniguchi et al. |
| 2015/0052778 | A1 | 2/2015 | Kirk et al. |
| 2015/0075031 | A1 | 3/2015 | Podhajny et al. |
| 2015/0143716 | A1 | 5/2015 | Long et al. |
| 2015/0143720 | A1 | 5/2015 | Avar |
| 2015/0201705 | A1 | 7/2015 | Doremus et al. |
| 2015/0201707 | A1 | 7/2015 | Bruce |
| 2015/0202915 | A1 | 7/2015 | Lee |
| 2015/0272274 | A1 | 10/2015 | Berns et al. |
| 2015/0282564 | A1 | 10/2015 | Meschter et al. |
| 2015/0282565 | A1 | 10/2015 | Kilgore |
| 2015/0305442 | A1 | 10/2015 | Ravindran |
| 2015/0313316 | A1 | 11/2015 | Boucher et al. |
| 2015/0320139 | A1 | 11/2015 | Peitzker et al. |
| 2015/0342286 | A1 | 12/2015 | Huffman et al. |
| 2015/0374064 | A1 | 12/2015 | Pierobon |
| 2016/0021979 | A1 | 1/2016 | Iuchi et al. |
| 2016/0029736 | A1 | 2/2016 | Meir |
| 2016/0058100 | A1 | 3/2016 | Dealey et al. |
| 2016/0076178 | A1 | 3/2016 | Head et al. |
| 2016/0088899 | A1 | 3/2016 | Liles et al. |
| 2016/0095377 | A1 | 4/2016 | Tamm |
| 2016/0106182 | A1 | 4/2016 | Ching-Ting |
| 2016/0166000 | A1 | 6/2016 | Bruce et al. |
| 2016/0166007 | A1 | 6/2016 | Bruce et al. |
| 2016/0166010 | A1 | 6/2016 | Bruce et al. |
| 2016/0168774 | A1 | 6/2016 | Breithaupt et al. |
| 2016/0174660 | A1 | 6/2016 | Iuchi et al. |
| 2016/0185062 | A1 | 6/2016 | Boucher et al. |
| 2016/0206044 | A1 | 7/2016 | Dimoff et al. |
| 2016/0208421 | A1 | 7/2016 | Baines et al. |
| 2016/0213095 | A1 | 7/2016 | Kohatsu et al. |
| 2016/0286898 | A1 | 10/2016 | Manz et al. |
| 2016/0345675 | A1 | 12/2016 | Bruce et al. |
| 2016/0345676 | A1 | 12/2016 | Bruce et al. |
| 2016/0345677 | A1 | 12/2016 | Bruce et al. |
| 2017/0020231 | A1 | 1/2017 | Hausmann et al. |
| 2017/0035149 | A1 | 2/2017 | Bruce et al. |
| 2017/0138513 | A1 | 5/2017 | Andresen et al. |
| 2017/0325545 | A1 | 11/2017 | Becker et al. |
| 2017/0325546 | A1 | 11/2017 | Becker et al. |
| 2017/0347754 | A1 | 12/2017 | Fuerst, Jr. et al. |
| 2018/0020762 | A1 | 1/2018 | Jamison |
| 2018/0213878 | A1 | 8/2018 | Bruce |
| 2018/0242689 | A1 | 8/2018 | Bruce et al. |
| 2018/0343959 | A1 | 12/2018 | Bruce et al. |
| 2018/0343961 | A1 | 12/2018 | Bruce et al. |
| 2018/0343962 | A1 | 12/2018 | Bruce et al. |
| 2018/0343963 | A1 | 12/2018 | Bruce et al. |
| 2018/0368506 | A1 | 12/2018 | Bruce et al. |
| 2019/0008235 | A1 | 1/2019 | Wu |
| 2019/0014854 | A1 | 1/2019 | Santos et al. |
| 2019/0098955 | A1 | 4/2019 | Bruce |
| 2019/0150552 | A1 | 5/2019 | Casillas et al. |
| 2019/0231031 | A1 | 8/2019 | Bruce et al. |
| 2019/0254386 | A1 | 8/2019 | Bruce et al. |
| 2020/0146390 | A1 | 5/2020 | Heidenfelder et al. |

FOREIGN PATENT DOCUMENTS

| | | | |
|---|---|---|---|
| CN | 1121403 | A | 5/1996 |
| CN | 2930360 | Y | 8/2000 |
| CN | 1883325 | A | 12/2006 |
| CN | 201175007 | Y | 1/2009 |
| CN | 101426390 | A | 5/2009 |
| CN | 201356120 | Y | 12/2009 |
| CN | 101627843 | A | 1/2010 |
| CN | 101801229 | A | 8/2010 |
| CN | 102271548 | A | 12/2011 |
| CN | 202536202 | U | 11/2012 |
| CN | 202635759 | U | 1/2013 |
| CN | 102987631 | A | 3/2013 |
| CN | 202950101 | U | 5/2013 |
| CN | 103415657 | A | 11/2013 |
| CN | 203369442 | U | 1/2014 |
| CN | 103653542 | A | 3/2014 |
| CN | 203676256 | U | 7/2014 |
| CN | 20403521 | U | 12/2014 |
| CN | 104185431 | A | 12/2014 |
| CN | 204526335 | U | 8/2015 |
| CN | 105246362 | A | 1/2016 |
| CN | 205831190 | U | 12/2016 |
| DE | 726634 | C | 10/1942 |
| DE | 1140107 | B | 11/1962 |
| DE | 4306286 | A1 | 9/1993 |
| DE | 19809085 | A1 | 8/1999 |
| DE | 102011011185 | A1 | 8/2012 |
| DE | 102011119245 | A1 | 10/2012 |
| DE | 102012020216 | A1 | 4/2014 |
| DE | 202015101672 | U1 | 4/2015 |
| EP | 0372370 | A2 | 6/1990 |
| EP | 1486601 | A1 | 12/2004 |
| EP | 2657384 | A1 | 10/2013 |
| EP | 2792261 | A1 | 10/2014 |
| EP | 2792264 | A2 | 10/2014 |
| EP | 2811056 | A1 | 12/2014 |
| EP | 3011855 | A1 | 4/2016 |
| FR | 1012719 | A | 7/1952 |
| GB | 430805 | A | 6/1935 |
| GB | 477556 | A | 1/1938 |
| GB | 1083849 | | 9/1967 |
| GB | 1299353 | | 12/1972 |
| JP | S51107964 | U1 | 8/1976 |
| JP | H07054250 | | 2/1995 |
| JP | H0733076 | B2 | 4/1995 |
| JP | H07216703 | | 8/1995 |
| JP | 08109553 | A | 4/1996 |
| JP | 09322810 | A | 12/1997 |
| JP | 10-158965 | A | 6/1998 |

(56) References Cited

FOREIGN PATENT DOCUMENTS

| | | | |
|---|---|---|---|
| JP | 2001030361 | A | 2/2001 |
| JP | 2004105323 | A | 4/2004 |
| JP | 2004339651 | A | 12/2004 |
| JP | 20050422266 | A | 2/2005 |
| JP | 2005060885 | A | 3/2005 |
| JP | 2005102933 | A | 4/2005 |
| JP | 2005-160697 | A | 6/2005 |
| JP | 2005290628 | A | 10/2005 |
| JP | 2006009175 | A | 1/2006 |
| JP | 2006161167 | A | 6/2006 |
| JP | 2008-240187 | A | 10/2008 |
| JP | 6527230 | B2 | 5/2019 |
| KR | 2002-0038168 | A | 5/2002 |
| KR | 100737426 | B1 | 7/2007 |
| TW | 201105521 | A1 | 2/2011 |
| WO | 98/24616 | A1 | 6/1998 |
| WO | 0007475 | | 2/2000 |
| WO | 0036943 | A1 | 6/2000 |
| WO | 03016036 | A2 | 2/2003 |
| WO | 2009000371 | A1 | 12/2008 |
| WO | 2010080182 | A1 | 7/2010 |
| WO | 2010/100488 | A1 | 9/2010 |
| WO | 2011082391 | A1 | 7/2011 |
| WO | 2011111564 | A1 | 9/2011 |
| WO | 2011126837 | A2 | 10/2011 |
| WO | 2011137405 | A1 | 11/2011 |
| WO | 201200912 | A1 | 8/2012 |
| WO | 2013071679 | A1 | 5/2013 |
| WO | 2013/126313 | A2 | 8/2013 |
| WO | 2013126313 | A2 | 8/2013 |
| WO | 2014134244 | A1 | 9/2014 |
| WO | 2014209594 | A1 | 12/2014 |
| WO | 2014209596 | A1 | 12/2014 |
| WO | 2016/093961 | A1 | 6/2016 |
| WO | 2016093961 | A1 | 6/2016 |
| WO | 2016191478 | A1 | 12/2016 |

OTHER PUBLICATIONS

Branscomb et al. "New Directions in Braiding", Journal of Engineered Fibers and Fabrics, http://www.jeffjournal.org vol. 8, Issue 2, 2013, pp. 11-24.

International Search Report and Written Opinion dated Sep. 19, 2014 in PCT/US2014/041659. 10 pages.

International Search Report and Written Opinion dated Sep. 23, 2014 in International Patent Application No. PCT/US2014/041669. 10 pages.

Australian Office Action dated May 28, 2016 for Australian Patent Application No. 2014303040, 6 Pages.

Australian Office Action dated May 28, 2016 for Australian Patent Application No. 2014303042, 5 Pages.

Non-Final Office Action dated Jun. 1, 2016 for U.S. Appl. No. 14/565,568, 5 pages.

Non-Final Office Action dated Jun. 22, 2016 in U.S. Appl. No. 14/495,252, 13 pages.

Non-Final Office Action dated Jul. 1, 2016 in U.S. Appl. No. 14/565,598, 10 pages.

Non-Final Office Action dated Aug. 19, 2016 for U.S. Appl. No. 14/163,438, 15 pages.

International Search Report and Written Opinion dated Aug. 19, 2016 for International Patent Application No. PCT/US2016/034107, 17 pages.

Canadian Examiner's Report dated Sep. 19, 2016 in Canadian Patent Application No. 2,910,349, 3 pages.

"International Search Report and Written Opinion dated Sep. 23, 2016 in International Patent Application No. PCT/2016/034109, 18 pages."

Final Office Action dated Dec. 9, 2016 in U.S. Appl. No. 14/565,598, 17 pages.

Non-Final Office Action dated Jan. 17, 2017 in U.S. Appl. No. 14/721,507, 12 pages.

Final Office Action dated Feb. 16, 2017 in U.S. Appl. No. 14/163,438, 17 pages.

Final Office Action dated Feb. 23, 2017 in U.S. Appl. No. 14/495,252, 15 pages.

http://www.apparelsearch.com/definitions/miscellaneous/braiding.htm.

European Search Report dated Mar. 14, 2017 for European Patent Application No. 16001887.5, 9 pages.

Canadian Examiner's Report dated Jun. 13, 2017 in Canadian Patent Application No. 2,910,350, 3 pages.

Non-Final Office Action dated Jun. 22, 2017 in U.S. Appl. No. 14/495,252, 13 pages. (no new refs).

Office Action dated Nov. 24, 2017 in Australian Patent Application No. 2015361198, 3 pages.

International Preliminary Report on Patentability dated Dec. 7, 2017 in International Patent Application No. PCT/US2016/034109, 11 pages.

International Preliminary Report on Patentability dated Dec. 7, 2017 in International Patent Application No. PCT/US2016/034107, 8 pages.

Final Office Action dated Nov. 1, 2017 in U.S. Appl. No. 14/495,252, 14 pages.

Final Office Action dated Aug. 14, 2017 in U.S. Appl. No. 14/721,507, 12 pages.

Non-Final Office Action dated Oct. 19, 2017 in U.S. Appl. No. 14/163,438, 18 pages.

Non-Final Office Action dated Oct. 27, 2017 in U.S. Appl. No. 14/566,215, 21 pages.

International Search Report and Written Opinion dated Apr. 4, 2016 for International Patent Application No. PCT/US2015055902, 17 pages.

International Search Report and Written Opinion dated Jun. 16, 2016 in International Patent Application No. PCT/US2015/055868, 11 pages.

International Preliminary Report on Patentability dated Jun. 22, 2017 in International Patent Application No. PCT/US2015/056533, 6 pages.

International Preliminary Report on Patentability dated Jun. 22, 2017 in International Patent Application No. PCT/US2015/055868, 10 pages.

International Preliminary Report on Patentability dated Jun. 22, 2017 in International Patent Application No. PCT/US2015/055902, 10 pages.

Canadian Examiner's Report dated Jun. 28, 2017 in Canadian Patent Application No. 2,910,349, 3 pages.

Non-Final Office Action dated Aug. 23, 2017 in U.S. Appl. No. 14/565,598, 15 pages.

Office Action dated Feb. 12, 2018 in Australian Patent Application No. 2015361198, 3 pages.

Non-Final Office Action dated Mar. 7, 2018 in U.S. Appl. No. 14/721,450, 7 pages.

Non-Final Office Action dated Mar. 29, 2018 in U.S. Appl. No. 14/495,252, 14 pages.

Non-Final Office Action dated May 10, 2018 in U.S. Appl. No. 14/565,598, 17 pages.

Final Office Action dated Jun. 26, 2018 in U.S. Appl. No. 14/566,215, 17 pages.

Final Office Action dated Jul. 13, 2018 in U.S. Appl. No. 14/163,438, 15 pages.

Final Office Action dated Aug. 27, 2018 in U.S. Appl. No. 14/721,450, 9 pages.

Decision to grant a European patent pursuant to Article 97(1) dated Nov. 8, 2018 in European Patent Application No. 14737100.9, 1 page.

Communication pursuant to Article 94(3) dated Nov. 22, 2018 in European Patent Application No. 16731401.2, 5 pages.

Communication pursuant to Article 94(3) dated Nov. 23, 2018 in European Patent Application No. 15787425.6, 7 pages.

Final Office Action dated Dec. 14, 2018 in U.S. Appl. No. 14/565,598, 22 pages.

Non-Final Office Action dated Dec. 28, 2018 in U.S. Appl. No. 14/721,450, 6 pages.

(56) References Cited

OTHER PUBLICATIONS

Notice of Allowance dated Jan. 11, 2019 in U.S. Appl. No. 15/613,983, 7 pages.
Final Office Action dated Sep. 11, 2018 in U.S. Appl. No. 14/495,252, 14 pages.
Non-Final Office Action dated Sep. 18, 2018 in U.S. Appl. No. 15/613,983, 7 pages.
Non-Final Office Action dated Oct. 1, 2018 in U.S. Appl. No. 14/820,822, 15 pages.
International Search Report and Written Opinion dated Sep. 10, 2018 in International Patent Application No. PCT/US2018/035404, 13 pages.
International Search Report and Written Opinion dated Apr. 15, 2019 in International Patent Application No. PCT/US2018/061502, 18 pages.
Extended Search Report dated Aug. 16, 2019 in European Patent Application No. 18202740.9, 11 pages.
Non-Final Office Action dated Aug. 19, 2019 in U.S. Appl. No. 14/163,438, 15 pages.
Non-Final Office Action dated Aug. 21, 2009 in U.S. Appl. No. 14/566,215, 21 pages.
Notice of Allowance dated Sep. 16, 2019 in U.S. Appl. No. 14/721,450, 9 pages.
Communication under Rule 71(3) dated Feb. 20, 2019 in European Patent Application No. 15785032.2, 5 pages.
Communication under Rule 71(3) dated Mar. 13, 2019 in European Patent Application No. 15787396.9, 5 pages.
Partial search report dated Apr. 26, 2019 in European Patent Application No. 18202740.9, 13 pages.
Final Office Action dated May 1, 2019 in U.S. Appl. No. 14/721,450, 6 pages.
Communication pursuant to Article 94(3) dated May 13, 2019 in European Patent Application No. 16001887.5, 4 pages.
Communication under Rule 71(3) dated May 16, 2019 in European Patent Application No. 16731401.2, 5 pages.
Communication under Rule 71(3) dated Jun. 21, 2019 in European Patent Application No. 15785032.2, 2 pages.
Non-Final Office Action dated Jul. 9, 2019 in U.S. Appl. No. 14/721,450, 6 pages.
Final Office Action received for U.S. Appl. No. 14/163,438, dated Jan. 13, 2020, 12 pages.
International Search Report and Written Opinion received for PCT Patent Application No. PCT/US2019/036495, dated Nov. 8, 2019, 20 pages.
Non-Final Office Action received for U.S. Appl. No. 15/993,195, dated Feb. 6, 2020, 16 pages.
Non-Final Office Action dated Nov. 1, 2019 in U.S. Appl. No. 14/565,598, 18 pages.
Non-Final Office Action received for U.S. Appl. No. 15/993,180, dated Apr. 6, 2020, 13 pages.
Office Action received for European Patent Application No. 16727106.3, dated Apr. 8, 2020, 6 pages.
Extended European Search Report received for European Patent Application No. 19191026.4, dated Mar. 12, 2020, 12 pages.
Notice of Allowance received for U.S. Appl. No. 14/565,598, dated Mar. 16, 2020, 8 pages.
Non-Final Office Action received for U.S. Appl. No. 15/993,190, dated May 7, 2020, 11 pages.
Notice of Allowance received for U.S. Appl. No. 15/903,542, dated May 8, 2020, 9 pages.
International Preliminary Report on Patentability received for PCT Patent Application No. PCT/US2018/035404, dated Dec. 12, 2019, 8 pages.
Office Action received for European Patent Application No. 15787425.6, dated Jan. 23, 2020, 6 pages.
Summons to Attend Oral Proceedings received for European Patent Application No. 16001887.5, mailed on Dec. 2, 2019, 5 pages.
Final Office Action received for U.S. Appl. No. 14/566,215, dated Jan. 30, 2020, 26 pages.
Extended Search Report dated Nov. 29, 2019 in European Patent Application No. 19192467.9, 5 pages.
Partial search report dated Dec. 9, 2019 in European Patent Application No. 19191026.4, 15 pages.
International Preliminary Report on Patentability dated Dec. 12, 2019 in International Patent Application No. PCT/US2018/035417, 8 pages.
International Preliminary Report on Patentability dated Dec. 12, 2019 in International Patent Application No. PCT/US2018/035408, 10 pages.
Intention to Grant received for European Patent Application No. 16727106.3, dated Nov. 20, 2020, 8 pages.
Non-Final Office Action received for U.S. Appl. No. 15/993,180, dated Dec. 11, 2020, 14 pages.
Notice of Allowance received for U.S. Appl. No. 16/404,286, dated Nov. 25, 2020, 5 pages.
Office Action received for Canadian Patent Application No. 3020031, dated Nov. 24, 2020, 5 pages.
Intention to Grant received for European Patent Application No. 19192467.9, dated Oct. 6, 2020, 8 pages.
Office Action received for Indian Patent Application No. 201747020263, dated Sep. 18, 2020, 7 pages.
Office Action received for Sri Lankan Patent Application No. 20033, dated Aug. 14, 2020, 1 page.
Final Office Action received for U.S. Appl. No. 15/993,180, dated Jun. 12, 2020, 15 pages.
Intention to Grant received for European Patent Application No. 16001887.5, dated Jul. 28, 2020, 8 pages.
International Preliminary Report on Patentability received for PCT Patent Application No. PCT/US2018/061502, dated Jun. 4, 2020, 10 pages.
Non-Final Office Action received for U.S. Appl. No. 14/163,438, dated Jun. 25, 2020, 14 pages.
Non-Final Office Action received for U.S. Appl. No. 16/404,286, dated Jul. 22, 2020, 5 pages.
Non-Final Office Action received for U.S. Appl. No. 15/940,234, dated May 29, 2020, 12 pages.
Non-Final Office Action received for U.S. Appl. No. 16/192,129, dated Jun. 12, 2020, 10 pages.
Notice of Allowance received for U.S. Appl. No. 14/566,215, dated Aug. 12, 2020, 13 pages.
Notice of Allowance received for U.S. Appl. No. 15/993,195, dated Jun. 5, 2020, 5 pages.
Office Action received for Canadian Patent Application No. 3020031, dated Jun. 5, 2020, 5 pages.
Office Action received for European Patent Application No. 15787425.6, dated Aug. 5, 2020, 6 pages.
Office Action received for Indian Patent Application No. 201747019912, dated Jun. 16, 2020, 5 pages.
Office Action received for Indian Patent Application No. 201747019980, dated Jun. 16, 2020, 5 pages.
Final Office Action received for U.S. Appl. No. 15/940,234, dated Oct. 19, 2020, 10 pages.
Final Office Action received for U.S. Appl. No. 15/993,190, dated Oct. 14, 2020, 13 pages.
Final Office Action received for U.S. Appl. No. 16/192,129, dated Oct. 30, 2020, 10 pages.
Non-Final Office Action received for U.S. Appl. No. 16/207,427, dated Oct. 19, 2020, 16 pages.
Ntention to Grant received for European Patent Application No. 15787425.6, dated Apr. 28, 2021, 4 pages.
Notice of Allowance received for U.S. Appl. No. 15/993,180, dated Apr. 1, 2021, 11 pages.
Office Action received for European Patent Application No. 18202740.9, dated Mar. 26, 2021, 4 pages.
Final Office Action received for U.S. Appl. No. 16/207,427, dated May 13, 2021, 14 pages.
Non-Final Office action received for U.S. Appl. No. 15/993,190, dated Jun. 11, 2021, 11 pages.
Office Action received for European Patent Application No. 16751107, dated May 25, 2021, 7 pages.

* cited by examiner

MULTI-LAYERED BRAIDED ARTICLE AND METHOD OF MAKING

BACKGROUND

The present embodiments relate generally to braiding machines and articles of footwear made using braiding machines. Braiding machines are used to form braided textiles and to over-braid composite parts.

Braiding machines may form structures with various kinds of braiding patterns. Braided patterns are formed by intertwining three or more tensile strands (e.g., thread). The strands may be generally tensioned along the braiding direction.

SUMMARY

In one aspect, an upper assembly for an article of footwear, includes an outer braided structure and an inner braided structure. The outer braided structure includes a first portion having a jacquard braid pattern. The inner braided structure includes a second portion having a non-jacquard braid pattern.

In another aspect, article of footwear includes an upper assembly further comprised of an outer braided structure and an inner braided structure. The article also includes a sole structure. The outer braided structure has a first opening and the inner braided structure has a second opening. A collar portion of the inner braided structure extends through the first opening of the outer braided structure and wherein the second opening of the inner braided structure is configured to receive a foot. The outer braided structure includes a first portion having a jacquard braid pattern. The sole structure is disposed against the outer braided structure.

A method of making an upper assembly for an article of footwear includes moving a last and a braid point of a braiding machine relative to on another, where the braiding machine includes at least a first ring of spools and a second ring of spools, the second ring of spools being disposed concentrically within the first ring of spools on a surface of the braiding machine. The method also includes moving one or more spools along the second ring of spools to form an inner braided structure around an outer surface of the last. The method also includes moving one or more spools along the first ring of spools to form an outer braided structure around the inner braided structure, thereby forming the upper assembly comprised of the inner braided structure and the outer braided structure.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
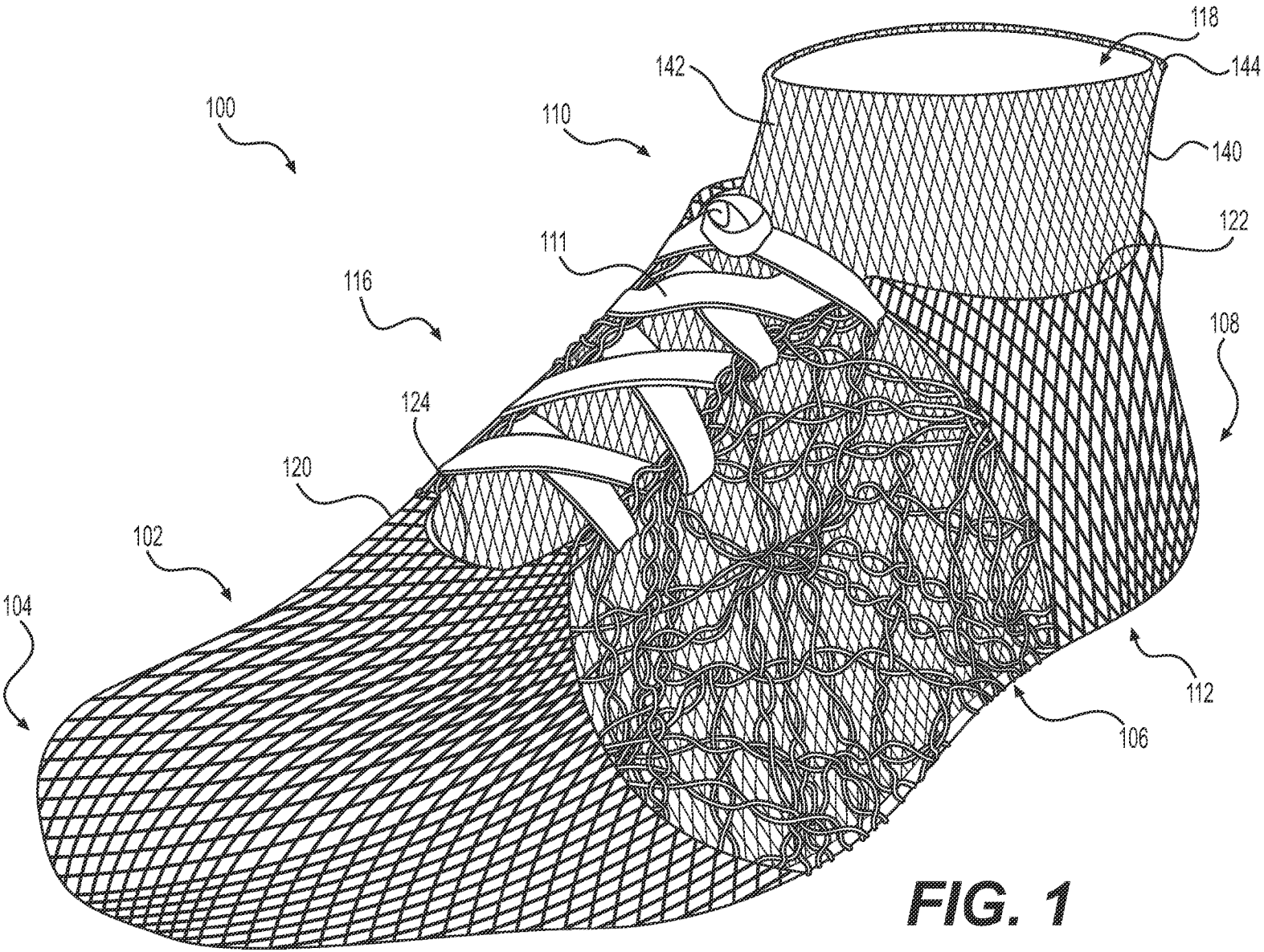
FIG. 1 is an isometric view of an embodiment of a braided article comprised of two layers.

The detailed description and the claims may make reference to various kinds of tensile elements, braided structures, braided configurations, braided patterns, and braiding machines.

As used herein, the term "tensile element" refers to any kinds of threads, yarns, strings, filaments, fibers, wires, cables as well as possibly other kinds of tensile elements described below or known in the art. As used herein, tensile elements may describe generally elongated materials with lengths much greater than their corresponding diameters. In some embodiments, tensile elements may be approximately one-dimensional elements. In some other embodiments, tensile elements may be approximately two-dimensional (e.g., with thicknesses much less than their lengths and widths). Tensile elements may be joined to form braided structures. A "braided structure" may be any structure formed by intertwining three or more tensile elements together. Braided structures could take the form of braided cords, ropes, or strands. Alternatively, braided structures may be configured as two-dimensional structures (e.g., flat braids) or three-dimensional structures (e.g., braided tubes) such as with lengths and width (or diameter) significantly greater than their thicknesses.

A braided structure may be formed in a variety of different configurations. Examples of braided configurations include, but are not limited to, the braiding density of the braided structure, the braid tension(s), the geometry of the structure (e.g., formed as a tube, an article, etc.), the properties of individual tensile elements (e.g., materials, cross-sectional geometry, elasticity, tensile strength, etc.) as well as other features of the braided structure. One specific feature of a braided configuration may be the braid geometry, or braid pattern, formed throughout the entirety of the braided configuration or within one or more regions of the braided structure. As used herein, the term "braid pattern" refers to the local arrangement of tensile strands in a region of the braided structure. Braid patterns can vary widely and may differ in one or more of the following characteristics: the orientations of one or more groups of tensile elements (or strands), the geometry of spaces or openings formed between braided tensile elements, the crossing patterns between various strands as well as possibly other characteristics. Some braided patterns include lace-braided or jacquard patterns, such as Chantilly, Bucks Point, and Torchon. Other patterns include biaxial diamond braids, biaxial regular braids, as well as various kinds of triaxial braids.

Braided structures may be formed using braiding machines. As used herein, a "braiding machine" is any machine capable of automatically intertwining three or more tensile elements to form a braided structure. Braiding machines may generally include spools, or bobbins, that are moved or passed along various paths on the machine. As the spools are passed around, tensile strands extending from the spools toward a center of the machine may converge at a "braiding point" or braiding area. Braiding machines may be characterized according to various features including spool control and spool orientation. In some braiding machines, spools may be independently controlled so that each spool can travel on a variable path throughout the braiding process, hereafter referred to as "independent spool control." Other braiding machines, however, may lack independent spool control, so that each spool is constrained to travel along a fixed path around the machine. Additionally, in some braiding machines, the central axes of each spool point in a common direction so that the spool axes are all parallel, hereby referred to as an "axial configuration." In other braiding machines, the central axis of each spool is oriented toward the braiding point (e.g., radially inward from the perimeter of the machine toward the braiding point), hereby referred to as a "radial configuration."

One type of braiding machine that may be utilized is a radial braiding machine or radial braider. A radial braiding machine may lack independent spool control and may therefore be configured with spools that pass in fixed paths around the perimeter of the machine. In some cases, a radial braiding machine may include spools arranged in a radial configuration. For purposes of clarity, the detailed description and the claims may use the term "radial braiding machine" to refer to any braiding machine that lacks independent spool control. The present embodiments could make use of any of the machines, devices, components, parts, mechanisms, and/or processes related to a radial braiding machine as disclosed in Dow et al., U.S. Pat. No. 7,908,956, issued March 22, 2011, and titled "Machine for Alternating Tubular and Flat Braid Sections," and as disclosed in Richardson, U.S. Pat. No. 5,257,571, issued Nov. 2, 1993, and titled "Maypole Braider Having a Three Under and Three Over Braiding path," with each application being herein incorporated by reference in its entirety. These applications may be hereafter referred to as the "Radial Braiding Machine" applications.

Another type of braiding machine that may be utilized is a lace braiding machine, also known as a Jacquard or Torchon braiding machine. In a lace braiding machine, the spools may have independent spool control. Some lace braiding machines may also have axially arranged spools. The use of independent spool control may allow for the creation of braided structures, such as lace braids, that have an open and complex topology, and may include various kinds of stitches used in forming intricate braiding patterns. For purposes of clarity, the detailed description and the claims may use the term "lace braiding machine" to refer to any braiding machine that has independent spool control. The present embodiments could make use of any of the machines, devices, components, parts, mechanisms, and/or processes related to a lace braiding machine as disclosed in Ichikawa, EP Patent Number 1486601, published on Dec. 15, 2004, and titled "Torchon Lace Machine," and as disclosed in Malhere, U.S. Patent Number 165,941, issued Jul. 27, 1875, and titled "Lace-Machine," with each application being herein incorporated by reference in its entirety. These applications may be hereafter referred to as the "Lace Braiding Machine" applications.

Spools may move in different ways according to the operation of a braiding machine. In operation, spools that are moved along a constant path of a braiding machine may be said to undergo "Non-Jacquard motions," while spools that move along variable paths of a braiding machine are said to undergo "Jacquard motions." Thus, as used herein, a lace braiding machine provides means for moving spools in Jacquard motions, while a radial braiding machine can only move spools in Non-Jacquard motions.

The embodiments may also utilize any of the machines, devices, components, parts, mechanisms, and/or processes related to a braiding machine as disclosed in Lee, U.S. patent application Ser. No. 14/721,563, filed on May 26, 2015, (now U.S. Pat. No. 10,218,176, issued on Mar. 26, 2019), entitled "Braiding Machine and Method of Forming an Article Incorporating Braiding Machine," the entirety of which is herein incorporated by reference and hereafter referred to as the "Fixed Last Braiding" application. The embodiments may also utilize any of the machines, devices, components, parts, mechanisms, and/or processes related to a lace braiding machine as disclosed in Lee, U.S. patent application Ser. No. 14/72,1614, filed on May 26, 2015, (now U.S. Pat. No. 10,280,538, issued on May 7, 2019, entitled "Method of Forming a Braided Component Incorporating a Moving Object," the entirety of which is herein incorporated by reference and hereafter referred to as the "Moving Last Braiding" application. Embodiments may also utilize any of the machines, devices, components, parts, mechanisms, and/or processes related to a braiding machine as disclosed in Lee, U.S. patent application Ser. No. 14/821,125, filed on the same date as the current application, now U.S. Pat. No. 9,920,462, issued on Mar. 20, 2018, entitled "Braiding Machine with Multiple Rings of Spools" the entirety of which is herein incorporated by reference and hereafter referred to as the "Multi-Ring Braid Machine application". Embodiments may also utilize any of the machines, devices, components, parts, mechanisms and/or processes related to a braiding machine or article formed using a braiding machine as disclosed in Bruce et al., U.S. patent application Ser. No. 14/721,507, filed on May 26, 2015 and published as U.S. Patent Publication Number 2016/0345675 on Dec. 1, 2016 (now abandoned), entitled "Hybrid Braided Article", the entirety of which is herein incorporated by reference and hereafter referred to as the "Hybrid Braided Article application".

FIG. 1 illustrates an isometric view of an embodiment of an article of footwear. In some embodiments, article of footwear 100, also referred to simply as article 100, is in the form of an athletic shoe. In some other embodiments, the provisions discussed herein for article 100 could be incorporated into various other kinds of footwear including, but not limited to: basketball shoes, hiking boots, soccer shoes, football shoes, sneakers, running shoes, cross-training shoes, rugby shoes, baseball shoes as well as other kinds of shoes. Moreover, in some embodiments, the provisions discussed herein for article of footwear 100 could be incorporated into various other kinds of non-sports related footwear, including, but not limited to: slippers, sandals, high-heeled footwear, loafers, as well as other kinds of footwear.

In some embodiments, article 100 may be characterized by various directional adjectives and reference portions. These directions and reference portions may facilitate in describing the portions of an article of footwear. Moreover, these directions and reference portions may also be used in describing sub-components of an article of footwear, for example, directions and/or portions of a midsole structure, an outer sole structure, an upper or any other components).

For consistency and convenience, directional adjectives are employed throughout this detailed description corresponding to the illustrated embodiments. The term "longitudinal" as used throughout this detailed description and in the claims refers to a direction extending a length of a component (e.g., an upper or sole component). A longitudinal direction may extend along a longitudinal axis, which itself extends between a forefoot portion and a heel portion of the component. Also, the term "lateral" as used throughout this detailed description and in the claims refers to a direction extending along a width of a component. A lateral direction may extend along a lateral axis, which itself extends between a medial side and a lateral side of a component. Furthermore, the term "vertical" as used throughout this detailed description and in the claims refers to a direction extending along a vertical axis, which itself is generally perpendicular to a lateral axis and a longitudinal axis. For example, in cases where an article is planted flat on a ground surface, a vertical direction may extend from the ground surface upward. Additionally, the term "inner" refers to a portion of an article disposed closer to an interior of an article, or closer to a foot when the article is worn. Likewise, the term "outer" refers to a portion of an article disposed further from the interior of the article or from the foot. Thus, for example, the inner surface of a component is disposed closer to an interior of the article than the outer surface of the component. This detailed description makes use of these directional adjectives in describing an article and various components of the article, including an upper, a midsole structure and/or an outer sole structure.

As shown in FIG. 1, article 100 may be associated with the left foot; however, it should be understood that the following discussion may equally apply to a mirror image of article 100 that is intended for use with a left foot.

For purpose of reference, article 100 may be divided into forefoot portion 104, midfoot portion 106, and heel portion 108. Forefoot portion 104 may be generally associated with the toes and joints connecting the metatarsals with the phalanges. Midfoot portion 106 may be generally associated with the arch of a foot. Likewise, heel portion 108 may be generally associated with the heel of a foot, including the calcaneus bone. Article 100 may also include an ankle portion 110 (which may also be referred to as a cuff portion). In addition, article 100 may include lateral side 112 and medial side 116. In particular, lateral side 112 and medial side 116 may be opposing sides of article 100. In general, lateral side 112 may be associated with the outside parts of a foot while medial side 116 may be associated with the inside part of a foot. Furthermore, lateral side 112 and medial side 116 may extend through forefoot portion 104, midfoot portion 106, and heel portion 108.

It will be understood that forefoot portion 104, midfoot portion 106, and heel portion 108 are only intended for purposes of description and are not intended to demarcate precise regions of article 100. Likewise, lateral side 112 and medial side 116 are intended to represent generally two sides rather than precisely demarcating article 100 into two halves.

Figure 2:
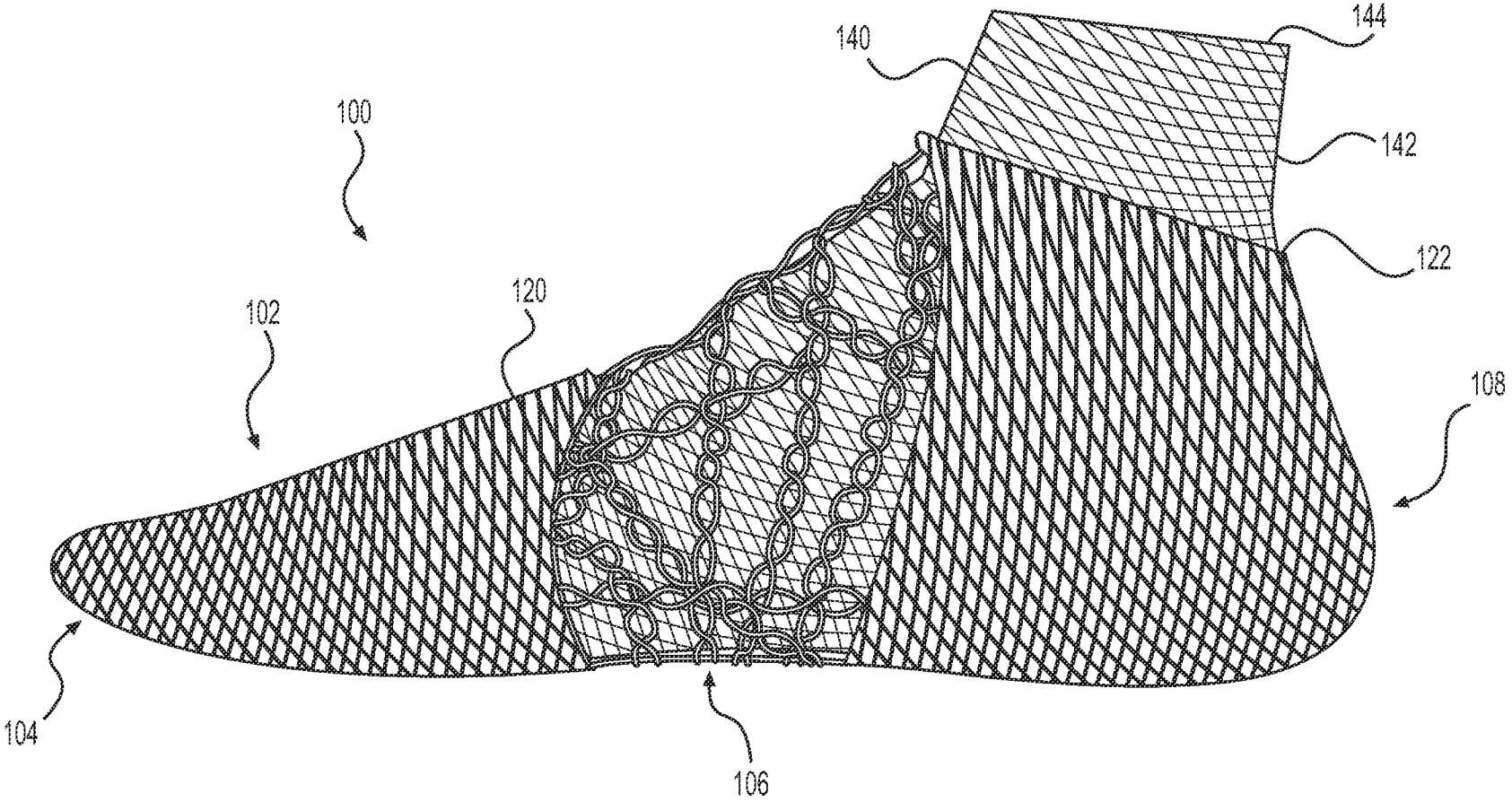
FIG. 2 is a side view of the braided article of FIG. 1.

FIG. 2 illustrates a side of article 100. Referring to FIGS. 1-2, article 100 may be configured with an upper assembly 102. In some embodiments, upper assembly 102 may be comprised of a single layer. In other embodiments, upper assembly 102 may be comprised of two or more layers. In embodiments utilizing two or more distinct layers, each layer may be comprised of a separate braided structure. For example, in FIG. 1, upper assembly 102 is comprised of outer braided structure 120 and inner braided structure 140. In other words, outer braided structure 120 is an outer (or exterior) layer of upper assembly 102, while inner braided structure 140 is an inner (or interior) layer of upper assembly 102. In still other embodiments, either an inner layer or an outer layer may not be a braided layer (i.e., a braided structure). In another embodiment (not shown), an outer layer may be braided while an inner layer may comprise a thin woven fabric or nonwoven material.

Upper assembly 102 may include an ankle opening that provides access to interior cavity 118. In some embodiments, each layer may include an opening for an ankle. As seen in FIGS. 1-2, outer braided structure 120 includes an outer ankle opening periphery 122 that bounds an outer ankle opening. Moreover, a collar portion 142 of inner braided structure 140 extends through outer ankle opening periphery 122. Inner braided structure 140 may further include inner ankle opening periphery 144 that bounds an inner ankle opening, which is configured to directly receive a foot for insertion into interior cavity. In at least some embodiments, including the embodiment illustrated in FIGS. 1-2, outer braided structure 120 further includes an elongated opening periphery 124 that extends from outer ankle opening periphery 122 over an instep of upper assembly 102, and which bounds an elongated opening. In some embodiments, the elongated opening bounded by opening periphery 124 may be tightened using a fastening element, such as lace 111. For purposes of clarity, lace 111 is only shown in FIG. 1 and is omitted in later figures.

Some embodiments may not include a separate sole structure. For purposes of clarity, article 100 is shown without a sole structure. In some cases, for example, some or all portions of an outer braided structure could be configured to provide durability, strength, cushioning and/or traction along a lower surface of the article. In other embodiments, however, including the embodiment depicted in FIG. 18, and discussed below, may include a sole structure to improve durability, strength, cushioning and/or traction along a lower surface of an article.

Other embodiments of an article with a braided upper assembly could incorporate any other provisions associated with other kinds of articles. Such provisions could include, but are not limited to: laces, straps, cords and other kinds of fasteners, eyestays, eyelets, trim elements, pads, heel counters, heel cups, to guards, separate material panels, as well as any other provisions.

Figure 3:
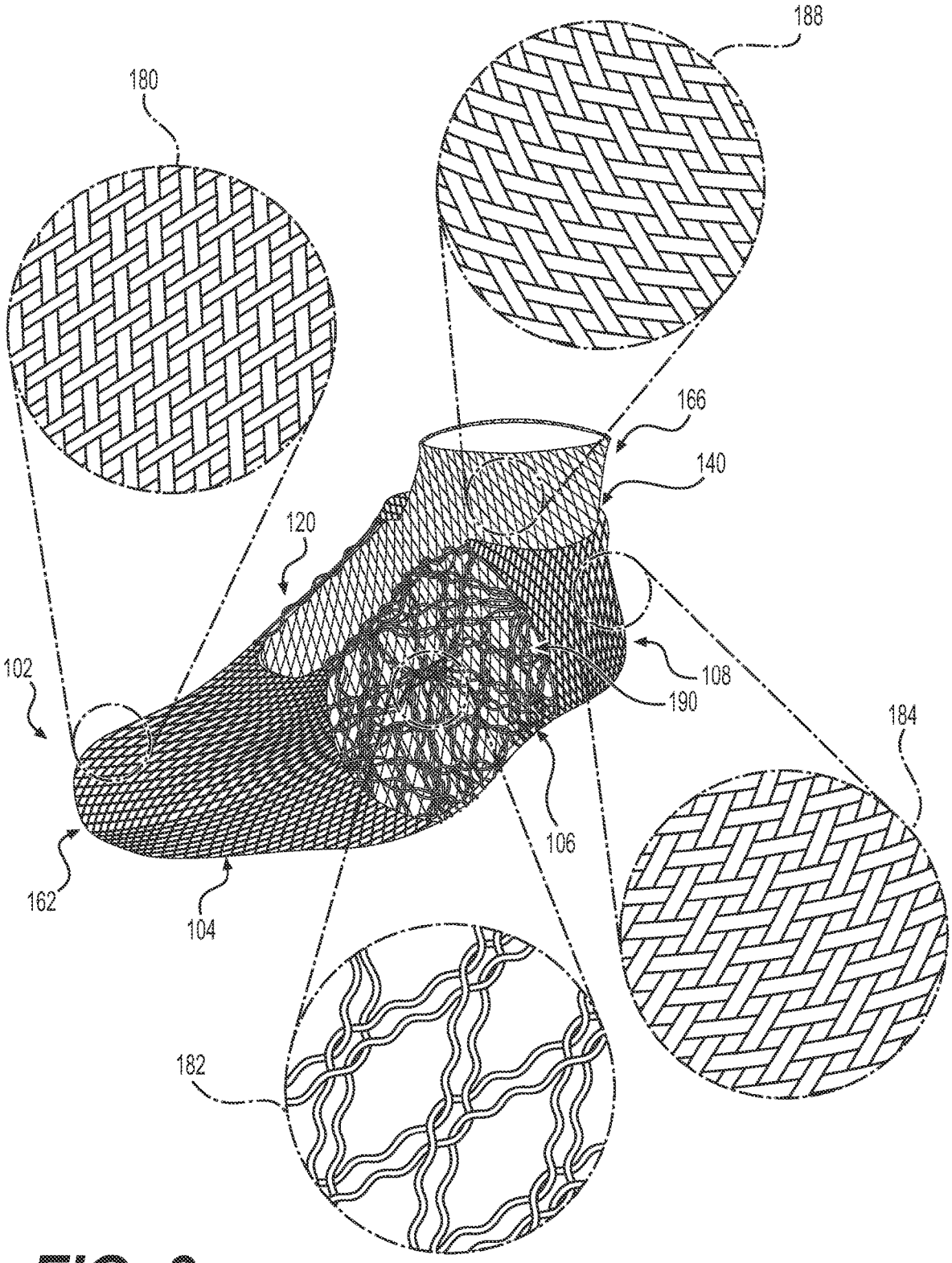
FIG. 3 is an isometric view of an embodiment of a braided article including two layers and multiple braid patterns.
Figure 4:
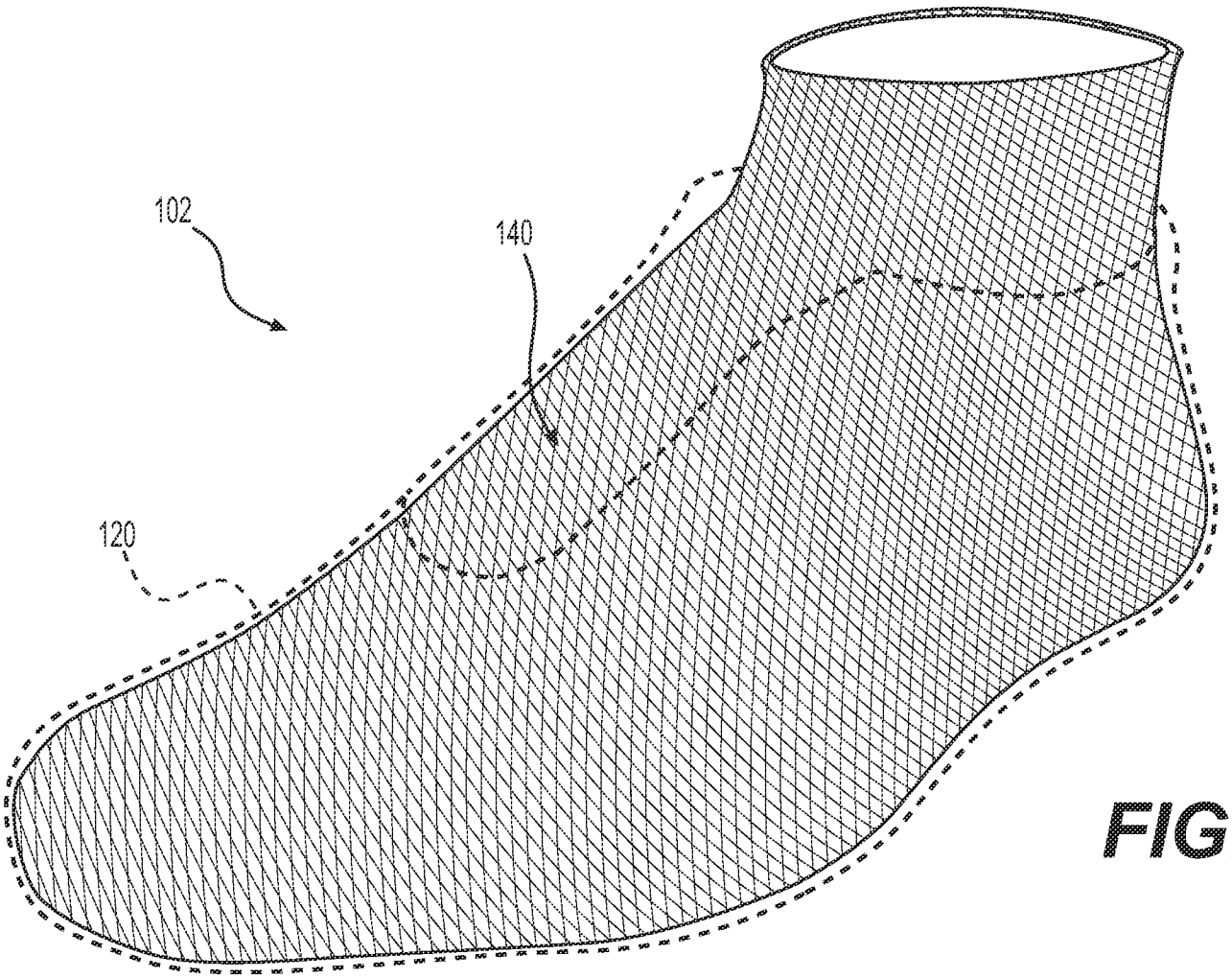
FIG. 4 is an isometric view of the article of FIG. 3, in which the outer layer is shown in phantom.

FIG. 3 illustrates an isometric view of an embodiment of upper assembly 102, including multiple enlarged regions that schematically depict the braided patterns of different regions. FIG. 4 illustrates an isometric view of an embodiment of upper assembly 102, in which outer braided structure 120 is shown in phantom for purposes of clarity. Referring to FIGS. 3-4, in some embodiments, outer braided structure 120 and inner braided structure 140 may be distinct structures with different characteristics. Exemplary characteristics that could vary between the two braided structures include, but are not limited to the braiding density of the braided structures, the braid tension(s), the geometry of the structures (e.g., formed as a tube, an article, etc.), the properties of individual tensile elements (e.g., materials, cross-sectional geometry, elasticity, tensile strength, etc.) as well as other features of the braided structures.

As seen in FIG. 4, inner braided structure 140 comprises a bootie-like layer or structure that may enclose the entire foot when upper assembly 102 is worn. Thus, inner braided structure 140 may be configured to directly contact a foot when worn, in some embodiments. In contrast, outer braided structure 120 encloses at least some of inner braided structure 140 so that an entirety of outer braided structure 120 is exposed on an exterior of upper assembly 102. In some cases, outer braided structure 120 may not contact any portions of a foot directly when upper assembly 102 is worn, as inner braided structure 140 may be disposed between all portions of outer braided structure 120 and a foot. Of course it may be understood that in other embodiments some portions of outer braided structure 120 could directly contact a foot, for example, via large openings in inner braided structure 140.

In different embodiments, the dimensions of each braided structure could vary. In some cases, one or more dimensions of a braided structure could be at least partially controlled by the thickness of tensile strands used to make the braided structure. In some embodiments, an outer braided structure and an inner braided structure could have similar thicknesses. In other embodiments, an outer braided structure and an inner braided structure could have different thicknesses. In the embodiment shown in FIG. 3, outer braided structure 120 and inner braided structure 140 may both have substantially similar thickness. In such cases, the resulting article may have twice the thickness of a single braided structure (or layer) in regions where two structures (layers) overlap. For example, in such embodiments, upper assembly 102 may be twice as thick in toe region 162 than in cuff region 166, since cuff region 166 comprises a single braided structure while toe region 162 comprises two braided structures layered together. This arrangement may allow for increased durability and strength in some regions of the foot (e.g., toes, midfoot and heel), while allowing for increased flexibility in other regions (e.g., the instep and the cuff).

Braided articles or braided structures can be formed with various kinds of braid patterns, as described above. The present embodiments may be characterized as having braid patterns than are "jacquard braid patterns" or "non-jacquard braid patterns". Jacquard braid patterns and non-jacquard braid patterns may refer to distinct classes of braid patterns. Thus jacquard braid patterns may comprise a variety of different braid patterns that share common features, and non-jacquard braid patterns may comprise a variety of different braid patterns that share common features. One type of jacquard braid pattern may be a lace braid pattern. Another type of jacquard braid pattern may be a Torchon braid pattern, or Torchon lace braid pattern. In contrast, non-jacquard braid patterns may be associated with bi-axial, tri-axial, diamond, or other kinds of regular braid patterns. In some cases, a non-jacquard braid pattern may be referred to as a radial braid pattern, as non-jacquard braid patterns can be easily formed using a radial braiding machine. However, it may be appreciated that in some cases non-jacquard braid patterns can also be formed from machines that may not be radial braiding machines. Thus, it should be appreciated that the terms "jacquard braid pattern" and "non-jacquard braid pattern" refer to the configuration of a braided structure, and may be independent of the type of machine, or method, used to make the braided structure.

Generally, jacquard braid patterns and non-jacquard braid patterns may have different characteristics. For example, jacquard braid patterns may be characterized as more open, with spacing between adjacent tensile strands varying in a non-uniform manner. In contrast, non-jacquard braid patterns may generally be uniform. In some cases, non-jacquard braid patterns may be grid or lattice like. Jacquard and non-jacquard braid patterns can also be characterized by the presence or absence of ornamental designs. Specifically, jacquard braid patterns may feature one or more ornamental designs whereas non-jacquard braid patterns may lack such ornamental designs due to the nature in which they are formed (by moving spools around on a constant path of a braiding machine). Further, the density of tensile strands (e.g., the average number of strands in a given area) may be highly variable in a jacquard braid pattern and may change along multiple directions of the braided structure. In contrast, the density of tensile strands in a non-jacquard braid pattern may generally be constant, or change only along a single axial direction dictated by the method of forming a braided structure. Thus, while some non-jacquard braid patterns could have densities that vary along one axis of the structure, they may generally not vary in density along multiple different directions of the structure.

As shown in FIG. 3, outer braided structure 120 includes regions having different braid patterns. For example, at least some of forefoot portion 104 is comprised of a non-jacquard braid pattern 180. Additionally, at least some of heel portion 108 is also comprised of a non-jacquard braid pattern 184. Also, at least some of midfoot portion 106 is comprised of a jacquard braid pattern 182. With this arrangement, upper assembly 102 may have physical properties that vary with different portions of outer braided structure 120. For example, in some embodiments, a braided structure with a jacquard braid pattern may have a lower density or greater elasticity than a braided structure with a non-Jacquard braid pattern. In still some cases, a braided structure with a jacquard braid pattern may further include intricate patterns and designs that may be absent from a braided structure with a non-Jacquard braid pattern. In some other cases, a braided structure with a non-Jacquard braid patterns may have a greater density and greater abrasion resistance than a braided structure with a Jacquard braid pattern.

As seen in FIG. 3, inner braided structure 140 may be comprised of non-jacquard braid pattern 188. Specifically, as clearly indicated in FIGS. 3-4, the entirety of inner braided structure 140 has non-jacquard braid pattern 188. Thus, inner braided structure 140 consists of a uniform and continuous braid pattern. In contrast, outer braided structure 120 comprises regions where the braid pattern changes and is non-uniform, for example at braid pattern transition region 190, which is indicated in FIG. 3.

As seen in FIGS. 3-4, both outer braided structure 120 and inner braided structure 140 are each full length braided structures. Specifically, outer braided structure 120 includes a forefoot portion, a midfoot portion and a heel portion. Likewise, inner braided structure 140 includes a forefoot portion, a midfoot portion and a heel portion. Thus, each braided structure comprises a structure configured to at least partially cover the forefoot, midfoot and heel of a foot.

In some embodiments, an outer braided structure and an inner braided structure could be attached. In some cases, an outer braided structure and an inner braided structure could be bonded together using an adhesive, for example. In one example (not shown), an outer braided structure and an inner braided structure could be fused along one or more locations of an article using a resin or polymer film. In some cases, an outer braided structure and an inner braided structure could be attached by one or more tensile strands that are integrated into both braided structures (e.g., by intertwining tensile strands from each structure with one another). In still other embodiments, an outer braided structure and an inner braided structure may be separated and not attached at any locations. An exemplary embodiment of separate braided structures is discussed below and shown in FIG. 19.

Figure 5:
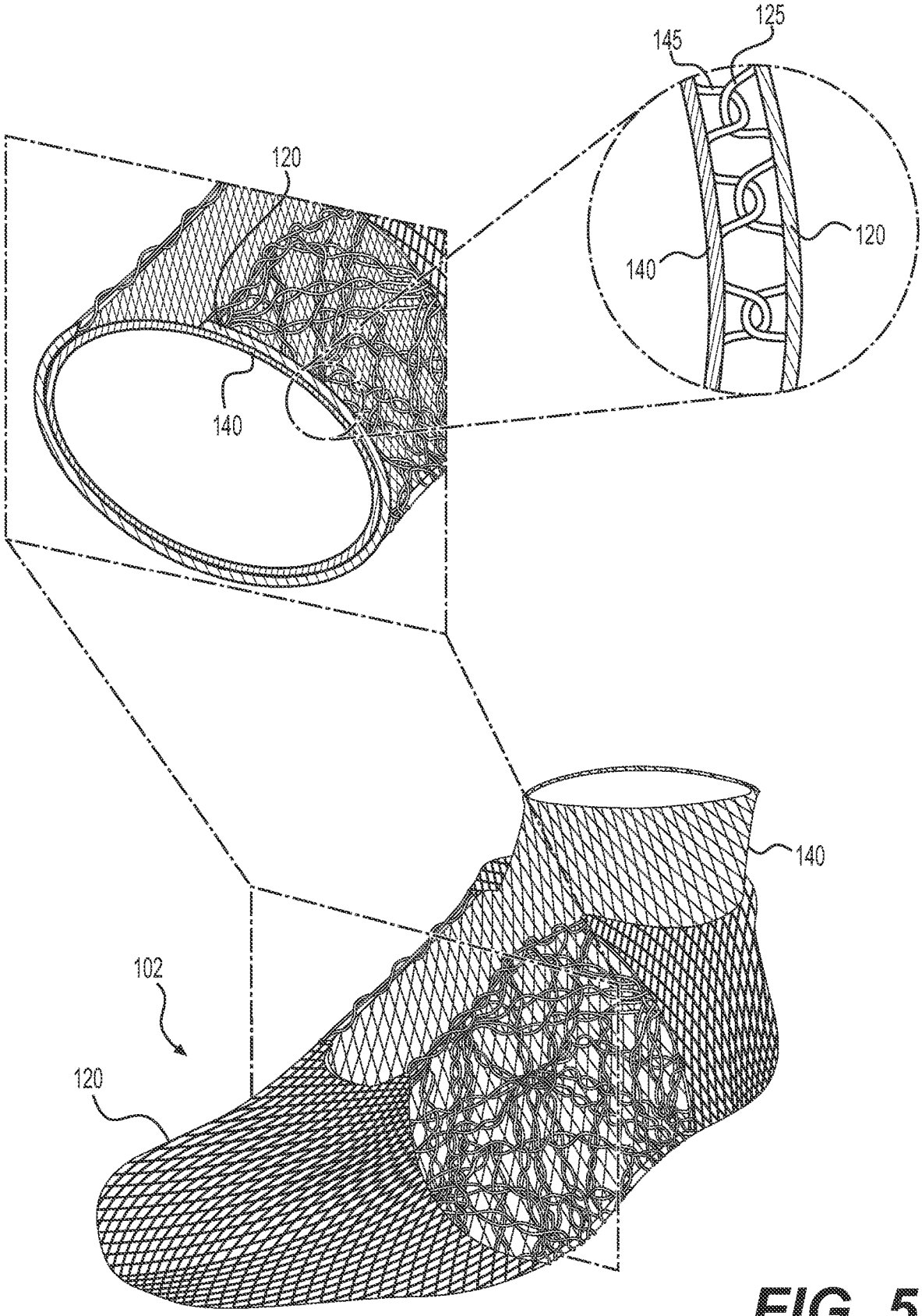
FIG. 5 is a schematic isometric view of an embodiment of an article of footwear including an enlarged cut-away view and a schematic cross-sectional view.

FIG. 5 illustrates a schematic view of an embodiment of upper assembly 102, including an enlarged cut-away view of a portion of upper assembly 102, as well as a schematic enlargement of the outer braided structure and the inner braided structure. As seen in FIG. 5, outer braided structure 120 and inner braided structure 140 may be joined along at least some portions of upper assembly 102. Specifically, some strands of outer braided structure 120 could engage (e.g., loop, twist or otherwise intertwine with) strands of outer braided structure 140. For example, one or more tensile strands 125 of outer braided structure 120 could engage with one or more tensile strands 145 of inner braided structure 140.

Figure 6:
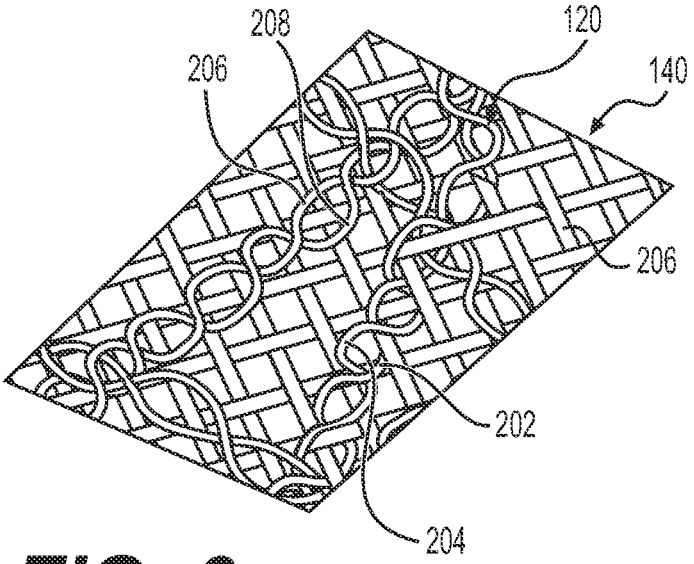
FIG. 6 is a schematic view of a portion of an upper assembly in which some tensile strands of an outer braided structure are interwoven with tensile strands of an inner braided structure, according to an embodiment.

FIG. 6 illustrates a schematic view of a section of upper assembly 102 including a portion of outer braided structure 120 and inner braided structure 140. Referring to FIG. 6, a first tensile strand 202 and second tensile strand 204 of outer braided structure 120 may engage with multiple tensile strands 206 of inner braided structure 140.

By intertwining tensile strands from outer braided structure 120 and inner braided structure 140, the two braided structures may be attached in a permanent manner that allows them to behave as a compound braided structure. Moreover, providing the intertwining at multiple different locations throughout the upper assembly allows for uniform attachment throughout upper assembly. This may be in contrast to other embodiments where two braided layers may be attached, or even integrally formed, along a single section, such as the collar or toe of an upper. Of course, the braided structures need not be attached at all locations. In the embodiment of FIG. 6, for example, a third tensile strand 206 and a fourth tensile strand 208 may not intertwine with inner braided structure 140, and instead may be disposed against an outer side of inner braided structure 140.

As shown in FIG. 6, tensile strands from one type of braid pattern in a first braided structure may be intertwined with tensile strands from another type of braid pattern in a second braided structure. Thus, for example, tensile strand 202 and tensile strand 204 comprise parts of a jacquard braid pattern in outer braided structure 120, and are intertwined with tensile strand 206 and tensile strand 208, which comprise parts of a non-jacquard braid pattern in inner braided structure 140. Of course, tensile strands of different braided structures may also be intertwined in configurations where adjacent portions of the braided structures comprise identical, or similar, braid patterns (e.g., both structures having a non-jacquard braid pattern).

For purposes of clarity, the embodiments depict intertwining between two tensile strands, one from each of two different braided structures. Of course in other embodiments intertwining of three or more tensile strands could occur, including two or more tensile strands from one of the outer braided structure or the inner braided structure.

It is to be appreciated that engagement between strands of an outer braided structure and an inner braided structure could occur at any locations throughout an upper assembly. Likewise, the number of locations where the strands engage could vary. Thus, the number of strands engaged (e.g., intertwined) at a single location, as well as the number and locations of the engagements, could vary to achieve different degrees of attachment of an outer braided structure and an inner braided structure. For example, in some embodiments, the inner and outer braided structures may only be attached in regions where both structures have a non-jacquard braid pattern. In other embodiments, such as the embodiment shown in FIGS. 5-6, tensile strands from different kinds of braid patterns could be intertwined.

Figure 7:
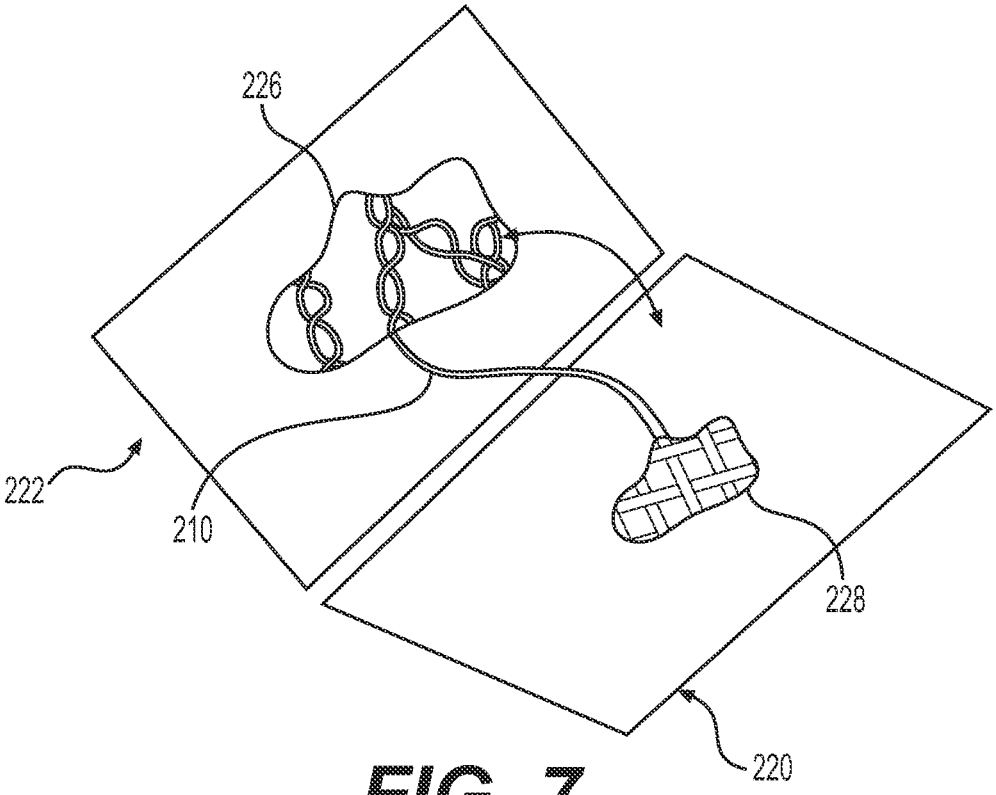
FIG. 7 is a schematic view of two braided structures in which a single tensile strand forms part of braid patterns in both braided structures, according to an embodiment.

In some embodiments, tensile strands from different braided structures may simply wrap around one another at various engagement locations, but each tensile strand may be associated with a particular structure and/or pattern throughout a majority of the article. In other embodiments, as shown in FIG. 7, a single tensile strand could have some portions incorporated into an inner braided structure and other portions incorporated into an outer braided structure. In FIG. 7, an outer braided structure 222 is shown lifted and rotated away from inner braided structure 220 for purposes of illustration. Referring to FIG. 7, a tensile strand 210 begins in an inner braided structure 220, but then passes to an outer braided structure 222. More specifically, a portion of tensile strand 210 comprises part of a jacquard braid pattern 226 in outer braided structure 222 and a different portion of tensile strand 210 comprises part of non-jacquard braid pattern 228 in inner braided structure 220. In such cases, each individual tensile strand could be incorporated into parts of an outer braided structure in some locations of an article, and parts of an inner braided structure in other locations of the article. In other words, in some cases, a single tensile strand could be part of a first braid pattern in one braided structure and a second braid pattern in a different braid structure. The first braid pattern and second braid pattern could be similar patterns or distinct patterns.

FIGS. 8-18 illustrate an embodiment of a method of making a braided article comprised of an outer braided structure and an inner braided structure, where the outer braided structure and the inner braided structure are formed simultaneously. In an exemplary embodiment, the outer braided structure and inner braided structure may both be formed on a braiding machine. One exemplary braiding machine for forming an upper assembly with an outer braided structure and an inner braided structure is described in the embodiments of FIGS. 8-18. However, it may be appreciated that other embodiments could utilize other kinds of machines, including, for example, one or more of the machines disclosed in the Multi-Ring Braid Machine application.

Figure 8:
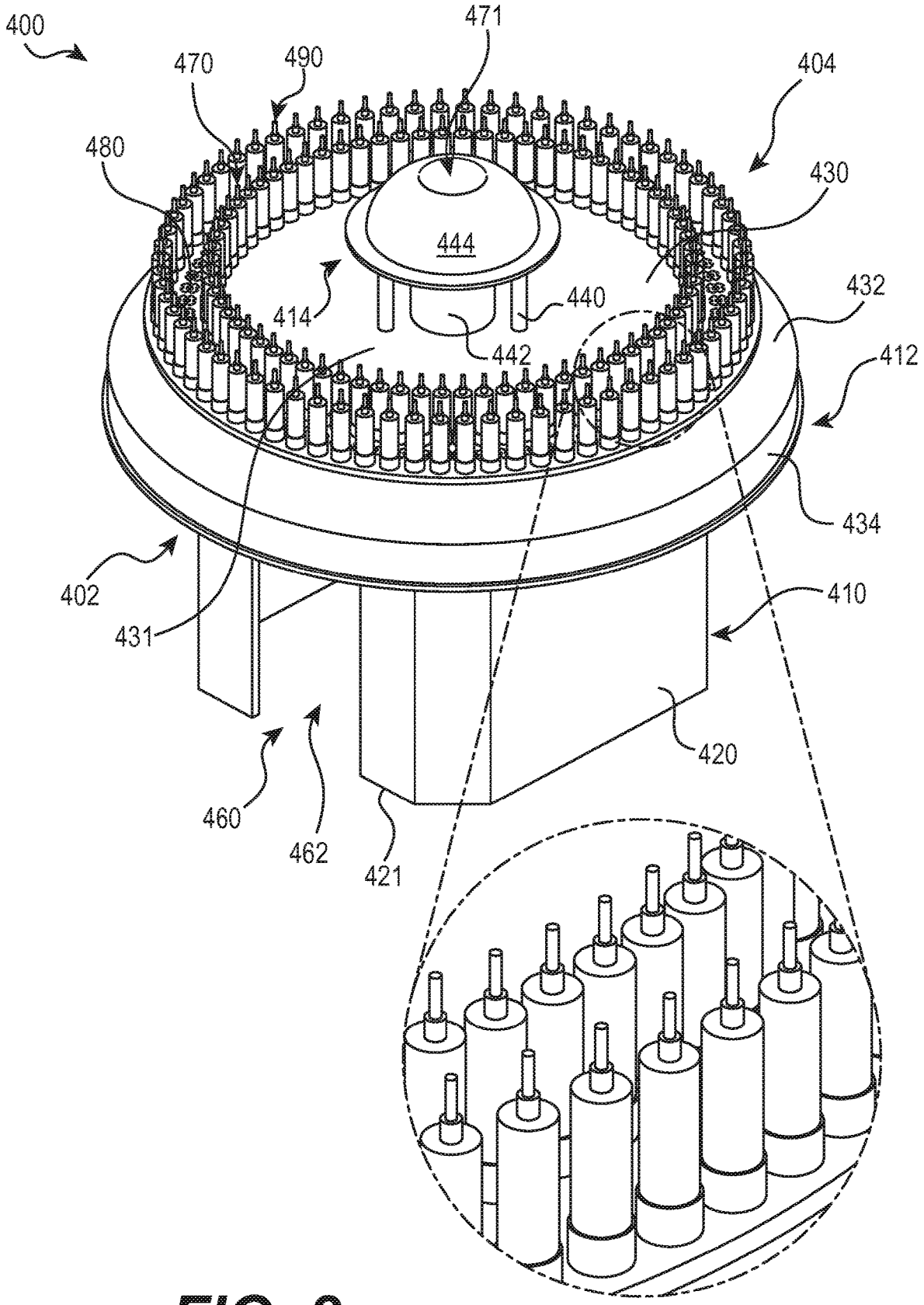
FIG. 8 is an isometric view of an embodiment of a braid machine with multiple rings of spools.

FIG. 8 illustrates an isometric view of an embodiment of a braiding machine 400. In some embodiments, braiding machine 400 may include a support structure 402 and a spool system 404. Support structure 402 may be further comprised of a base portion 410, a top portion 412 and a central fixture 414.

In some embodiments, base portion 410 may comprise one or more walls 420 of material. In the exemplary embodiment of FIG. 8, base portion 410 is comprised of four walls 420 that form an approximately rectangular base for braiding machine 400. However, in other embodiments, base portion 410 could comprise any other number of walls arranged in any other geometry. In this embodiment, base portion 410 acts to support top portion 412 and may therefore be formed in a manner so as to support the weight of top portion 412, as well as central fixture 414 and spool system 404, which are attached to top portion 412.

In some embodiments, top portion 412 may comprise a top surface 430, which may further include a central surface portion 431 and a peripheral surface portion 432. In some embodiments, top portion 412 may also include a sidewall surface 434 that is proximate peripheral surface potion 432. In the exemplary embodiment, top portion 412 has an approximately circular geometry, though in other embodiments, top portion 412 could have any other shape. Moreover, in the exemplary embodiment, top portion 412 is seen to have an approximate diameter that is larger than a width of base portion 410, so that top portion 412 extends beyond base portion 410 in one or more horizontal directions.

In order to provide means for passing lasts, mandrels, or similar provisions through braiding machine 400, the embodiment includes at least one sidewall opening 460 in base portion 410. In the exemplary embodiment, sidewall opening 460 may be disposed on wall 421 of walls 420. Sidewall opening 460 may further provide access to a central cavity 462 within base portion 410.

Figure 10:
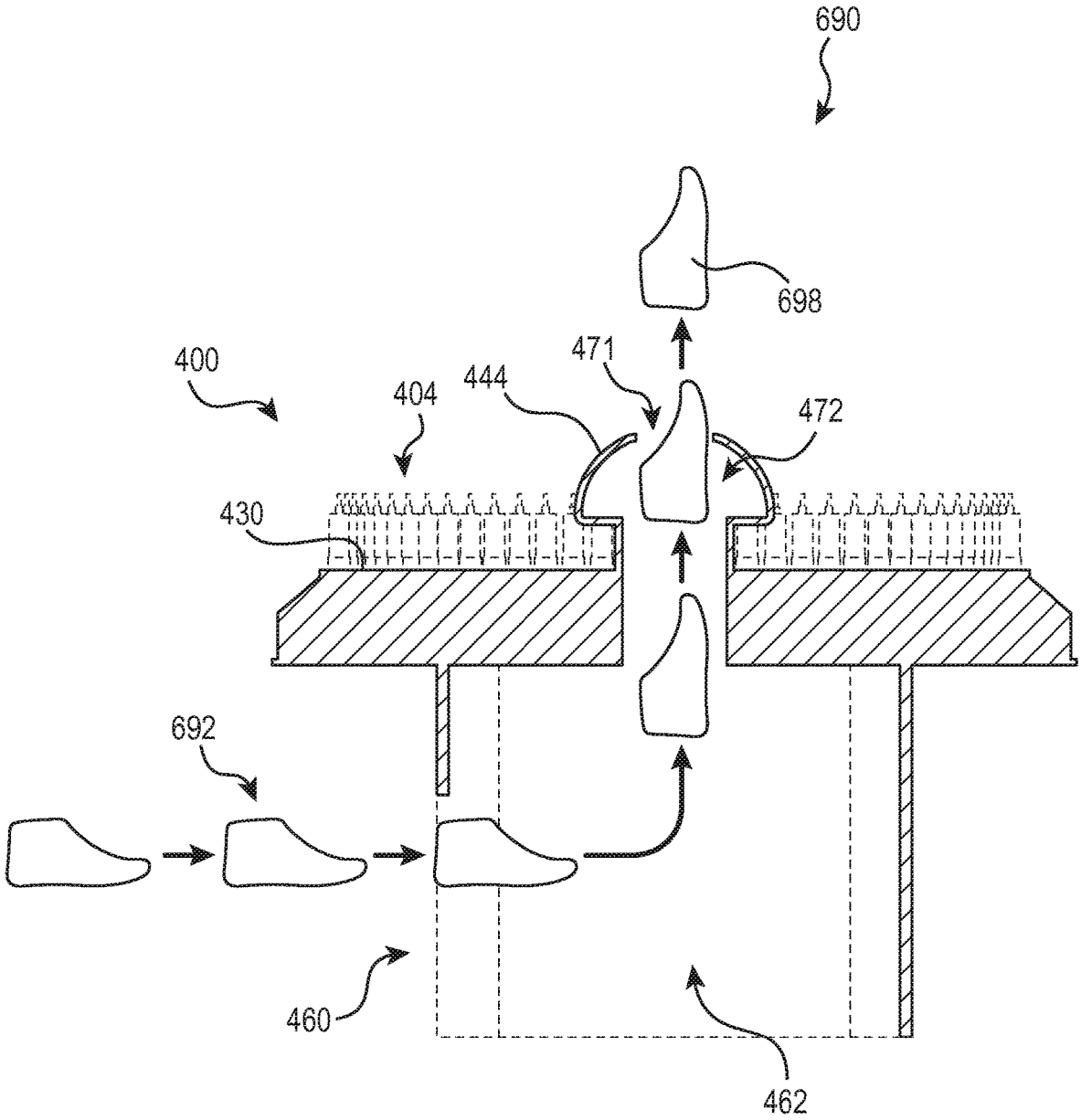
FIG. 10 is a schematic side cross-sectional view of the braid machine of FIG. 8.

Braiding machine 400 may include central fixture 414. In the exemplary embodiment, central fixture 414 includes one or more legs 440 and a central base 442. Central fixture 414 also includes a dome portion 444. In other embodiments, however, central fixture 414 could have any other geometry. As seen in FIG. 8, dome portion 444 includes an opening 471. Opening 471 is further connected to a central fixture cavity 472, which is best seen in FIG. 10.

Components of the support structure could be comprised of any materials. Exemplary materials that could be used include any materials with metals or metal alloys including, but not limited to, steel, iron, steel alloys, and/or iron alloys.

Figure 9:
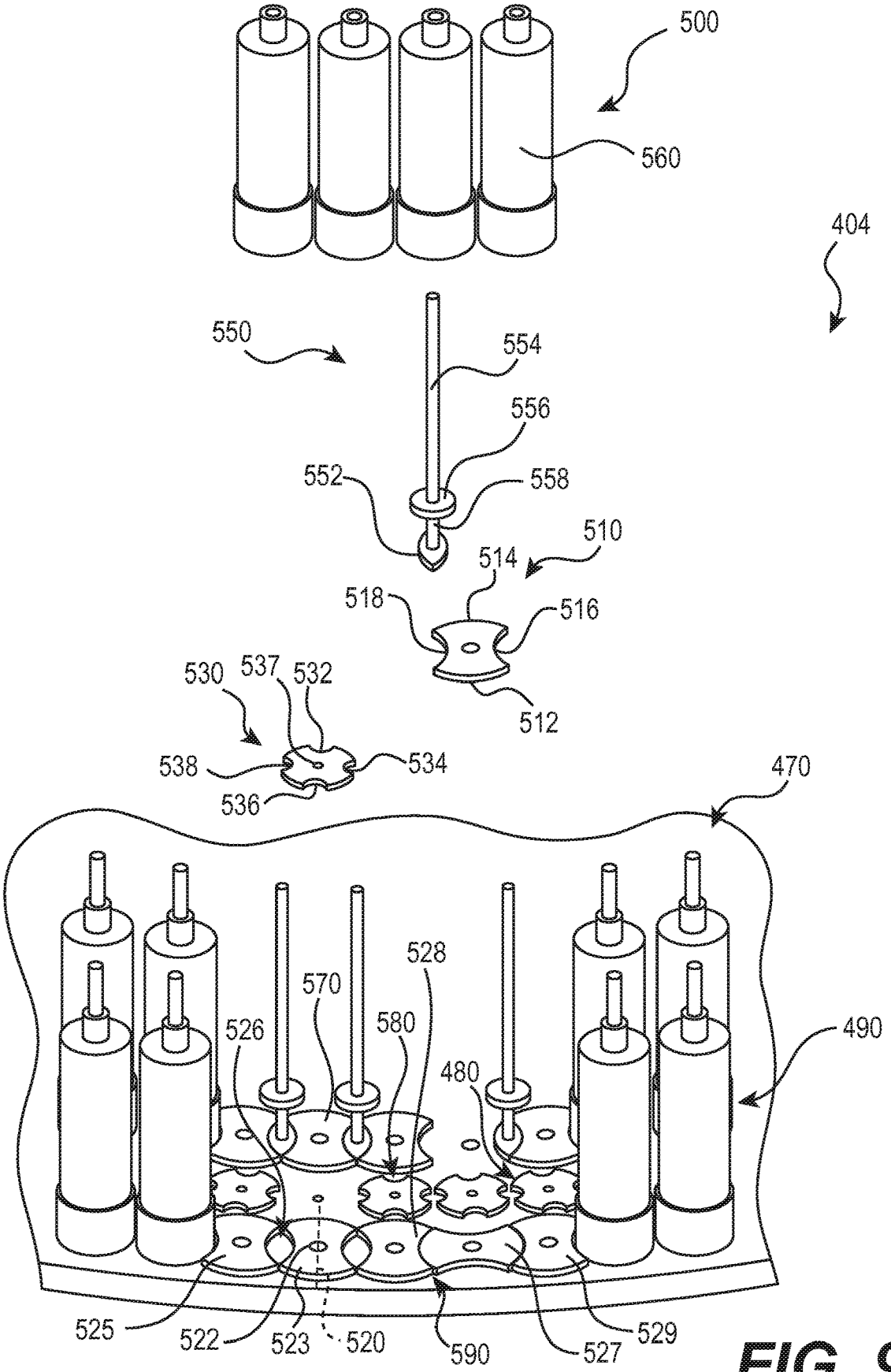
FIG. 9 is an isometric partial exploded view of a section of the braid machine of FIG. 8.

FIG. 9 illustrates a partially exploded view of some components of spool system 404. For purposes of clarity, some components have been removed and are not visible in FIG. 9. Referring now to FIG. 9, spool system 404 provides a means of intertwining threads from various spools of spool system 404.

Spool system 404 may be comprised of various components for passing or moving spools along the surface of braiding machine 400. In some embodiments, spool system 404 may include one or more spool-moving elements. As used herein, the term "spool-moving element" refers to any provision or component that may be used to move or pass a spool along a path on the surface of a braiding machine. Exemplary spool-moving elements include, but are not limited to, rotor metals, horn gears as well as possibly other kinds of gears or elements. The exemplary embodiments shown in the figures make use of both rotor metals and horn hears that rotate in place and facilitate passing carrier elements to which spools are mounted around in paths on the surface of the braiding machines.

In some embodiments, spool system 404 may include one or more rotor metals. Rotor metals may be used in moving spools along a track or path in a lace braiding machine, such as a Torchon braiding machine.

An exemplary rotor metal 510 is depicted in FIG. 9. Rotor metal 510 includes two opposing convex sides and two opposing concave sides. Specifically, rotor metal 510 includes first convex side 512, second convex side 514, first concave side 516 and second concave side 518. In some embodiments, all of the rotor metals comprising braiding machine 400 may have a similar size and geometry. In some other embodiments, however, rotor metals located along an inner ring (to be described below) may be slightly smaller in size than rotor metals located along an outer ring.

Rotor metals may rotate about an axis extending through a central opening. For example, a rotor metal 523 is configured to rotate about an axis 520 that extends through central opening 522. In some embodiments, central opening 522 may receive an axle or fastener (not shown) about which rotor metal 523 may rotate. Moreover, the rotor metals are positioned such that gaps may be formed between concave sides. For example, a gap 526 is formed between the concave sides of rotor metal 523 and an adjacent rotor metal 525.

As an individual rotor metal rotates, the convex portions of the rotating rotor metal pass by the concave sides of adjacent rotor metals without interference. For example, rotor metal 527 is shown in a rotated position such that the convex sides of rotor metal 527 fit into the concave sides of rotor metal 528 and rotor metal 529. In this way, each rotor metal can rotate in place so long as the opposing rotor metals are stationary during that rotation, in order to prevent interference (e.g., contact) between the convex sides of two adjacent rotor metals.

Spool system 404 may also include one or more horn gears. Horn gears may be used in moving spools along a track or path in a radial braiding machine. An exemplary horn gear 530 is depicted in FIG. 9. Horn gear 530 may have a rounded geometry, and may further include one or more notches or slots. In the exemplary embodiment, horn gear 530 includes a first slot 532, a second slot 534, a third slot 536 and a fourth slot 538. Horn gear 530 may further include a central opening 537 through which an axle or fastener can be inserted, and about which horn gear 530 may rotate. In contrast to the rotor metals that may be approximately symmetric about rotations of 180 degrees (since rotations of 90 degrees changes between a concave and convex side), horn gears may be approximately symmetric about rotations of 90 degrees.

Spool system 404 may include additional components, such as one or more carrier elements, which are configured to carry spools. One exemplary carrier element 550 is depicted in FIG. 9. In this exemplary embodiment, carrier element 550 includes a rotor engaging portion 552 and a rod portion 554. Rotor engaging portion 552 may be shaped to fit into a gap formed between the concave sides of two adjacent rotor metals (e.g., gap 526). In some embodiments, rotor engaging portion 552 has an approximately elliptic or elongated geometry. Alternatively, in other embodiments, rotor engaging portion 552 could have any other shape that could be accepted by, and passed between, adjacent rotor metals. Rod portion 554 may receive a corresponding spool. Optionally, carrier element 550 can include a flange portion 556 where a spool can sit, thereby creating a small intermediate rod portion 558 where carrier element 550 can be engaged by the slot of a horn gear. Of course, in other embodiments, carrier element 550 may include any other provisions for engaging rotor metals and/or horn gears, as well as for receiving spools. In at least some embodiments, it is contemplated that one or more horn gears may be raised slightly above one or more rotor metals such that the horn gears may engage a portion of a carrier element that is higher than a portion of the carrier element engaged by the rotor metals.

Spool system 404 may include additional components for controlling the motion of one or more rotor metals and/or horn gears. For example, embodiments can include one or more gear assemblies that act to drive the rotor metals and/or horn gears. Exemplary gear assemblies for controlling the rotation of rotor metals are disclosed in the Lace Braiding Machine applications, while gear assemblies for controlling the rotation of horn gears are disclosed in the Radial Braid Machine applications. It will be understood that still other gear assemblies are possible and one skilled in the art may choose types of gears and a particular arrangement of gears to achieve desired rotation speeds or other desired features for the rotor metals and horn gears of spool system 404.

Spool system 404 may also include one or more spools, which may alternatively be referred to as "spindles," "bobbins," and/or "reels." Each spool may be placed on a carrier element, thereby allowing the spool to be passed between adjacent rotor metals and/or horn gears. As seen in FIGS. 8-10, spool system 404 includes plurality of spools 500 that are mounted on associated carrier elements and which may be passed around the surface of braiding machine 400.

As seen in FIG. 9, plurality of spools 500 includes a spool 560. Spool 560 may be any kind of spool, spindle, bobbin, or reel that holds a tensile element for a braiding machine. As used here, the term "tensile element" refers to any kind of element that may be braided, knitted, woven, or otherwise intertwined. Such tensile elements, could include, but are not limited to, threads, yarns, strings, wires, cables as well as possibly other kinds of tensile elements. As used herein, tensile elements may describe generally elongated materials with lengths much greater than corresponding diameters. In other words, tensile elements may be approximately one-dimensional elements, in contrast to sheets or layers of textile materials that may generally be approximately two-dimensional (e.g., with thicknesses much less than their lengths and widths). The exemplary embodiment illustrates the use of various kinds of threads; however, it will be understood that any other kinds of tensile elements that are compatible with a braiding device could be used in other embodiments.

The tensile elements, such as thread, carried on spools of a braiding machine (e.g., braiding machine 400) may be formed of different materials. The properties that a particular type of thread will impart to an area of a braided component partially depend upon the materials that form the various filaments and fibers within the yarn. Cotton, for example, provides a soft hand, natural aesthetics, and biodegradability. Elastane and stretch polyester each provide substantial stretch and recovery, with stretch polyester also providing recyclability. Rayon provides high luster and moisture absorption. Wool also provides high moisture absorption, in addition to insulating properties and biodegradability. Nylon is a durable and abrasion-resistant material with relatively high strength. Polyester is a hydrophobic material that also provides relatively high durability. In addition to materials, other aspects of the thread selected for formation of a braided component may affect the properties of the braided component. For example, a thread may be a monofilament thread or a multifilament thread. The thread may also include separate filaments that are each formed of different materials. In addition, the thread may include filaments that are each formed of two or more different materials, such as a bi-component thread with filaments having a sheath-core configuration or two halves formed of different materials.

The components of spool system 404 may be organized into three rings, including an inner ring 470, an intermediate ring 480 and an outer ring 490 (see FIGS. 8-9). Each ring may be comprised of a set of components for passing spools along the ring. For example, inner ring 470 may be comprised of a first set of rotor metals 570 (see FIG. 9) arranged in a closed track or path. Intermediate ring 480 may be comprised of a set of horn gears 580 arranged in a closed track or path. Outer ring 490 may be comprised of a second set of rotor metals 590 (see FIG. 9) arranged in a closed track or path.

As best seen in FIG. 8, in the exemplary embodiment, inner ring 470, intermediate ring 480, and outer ring 490 may have a concentric arrangement. Specifically, inner ring 470 is concentrically arranged within intermediate ring 480. Also, intermediate ring 480 is concentrically arranged within outer ring 490. In other words, inner ring 470, intermediate ring 480, and outer ring 490 are arranged around a common center, and have different diameters. Also, inner ring 470 is seen to be closer to central fixture 414 than intermediate ring 480 and outer ring 490. Outer ring 490 is also seen to be closer to outer perimeter 409 of support structure 402.

It may be appreciated that rotor metals may generally not be visible in the isometric view of FIG. 8, as the rotor metals may be obscured by the presence of plurality of spools 500 placed on inner ring 470 and outer ring 490. However, as clearly illustrated in FIG. 9, each spool and carrier element in inner ring 470 or outer ring 490 may be held between two adjacent rotor metals.

Although each ring has a different diameter, the components of each ring may be arranged such that rotor metals of one ring are proximate horn gears of another ring. For example, in FIG. 9, first set of rotor metals 570 from inner ring 470 are proximate set of horn gears 580. Likewise, second set of rotor metals 590 from outer ring 490 are proximate set of horn gears 580. Specifically, each rotor metal of first set of rotor metals 570 is substantially close enough to at least one horn gear of set of horn gears 580 to allow a spool (mounted on a carrier element) to be passed between the rotor metal and the horn gear. In a similar manner, each rotor metal of second set of rotor metals 590 is substantially close enough to at least one horn gear of set of horn gears 580 to allow a spool (mounted on a carrier element) to be passed between the rotor metal and the horn gear.

It is contemplated that in some embodiments spools could be controlled in a manner to avoid collisions along any of the rings as spools are passed between rings. For example, in operating configurations where there are no open gaps or spaces between rotor metals on either the inner or outer ring, spool movement between rings may be coordinated to ensure that spools don't collide when arriving at the inner or outer ring. In some embodiments, for example, the motions of spools may be coordinated so that as a spool leaves the outer ring to transition to the inner ring, another spool in the inner ring transitions out of the inner ring to the intermediate ring, thereby opening a space for the spool transitioning from the outer ring to the inner ring. Thus, it may be appreciated that the spool motions between rings may be coordinated to ensure no collisions between spools occur at the outer ring, at the intermediate ring or at the inner ring.

It is also contemplated that in at least some embodiments, the horn gears disposed in the intermediate ring (e.g., intermediate ring 180) may be capable of independent rotational motion, rather than being controlled such that each gear has a constant direction and rate of rotation. In other words, in some other embodiments, horn gears could be controlled in jacquard motions, rather than only non-jacquard motions. This independent control for each horn gear might allow for more refined control over the movement of spools passing between rings, and in some cases may allow spools to pass along the intermediate ring in a holding pattern until spaces are opened in either the inner or outer ring.

The embodiment of FIGS. 8-10 includes a moveable last system 690, which is depicted schematically in FIG. 10. Moveable last system 690 further includes a plurality of lasts 692. Plurality of lasts 692 may be configured to enter braiding machine 400 through sidewall opening 460, pass through central cavity 462 and central fixture cavity 472, before finally passing out of opening 471 in dome portion 444. As each last emerges from opening 471, the last may pass through a braiding point of braiding machine 400 such that threads may be braided onto the surface of the last (not shown).

The lasts of plurality of lasts 692 may have any size, geometry, and/or orientation. In the exemplary embodiment, each last of plurality of lasts 692 comprises a three-dimensional contoured last in the shape of a foot (i.e., last member 698 is a footwear last). However, other embodiments could utilize lasts having any other geometry that are configured for forming braided articles with a preconfigured shape.

Upon entering braiding machine 400, each last may move in an approximately horizontal direction, which is any direction approximately parallel with top surface 430. After passing through sidewall opening 460 and into cavity 462, each last may then be rotated by approximately 90 degrees so that the last begins moving in an approximately vertical direction. The vertical direction may be a direction that is normal or perpendicular to top surface 430 of braiding machine 400. It may be appreciated that in some embodiments each last may be quickly rotated through 90 degrees to change the direction of its path. In other embodiments, each last may be turned along a curve such that the last is slowly rotated through approximately 90 degrees.

A moveable last system may include provisions for moving lasts through a braiding machine, including provisions for changing the direction in which the lasts move. These provisions could include various tracks, rollers, cables or other provisions for supporting lasts along a predetermined path.

Figure 11:
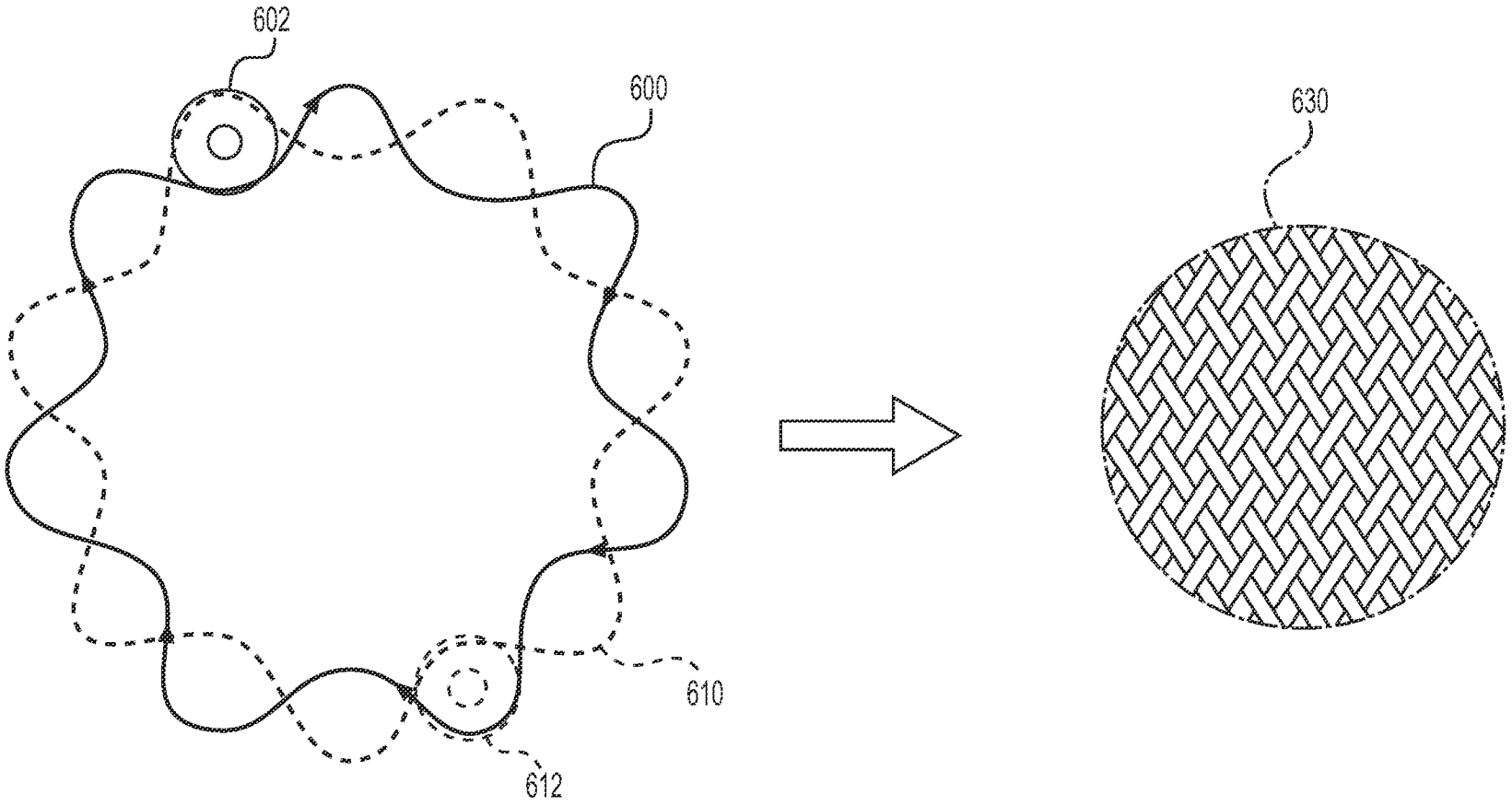
FIG. 11 is a schematic view of a fixed spool path configuration for a braiding machine and a corresponding braid pattern.
Figure 12:
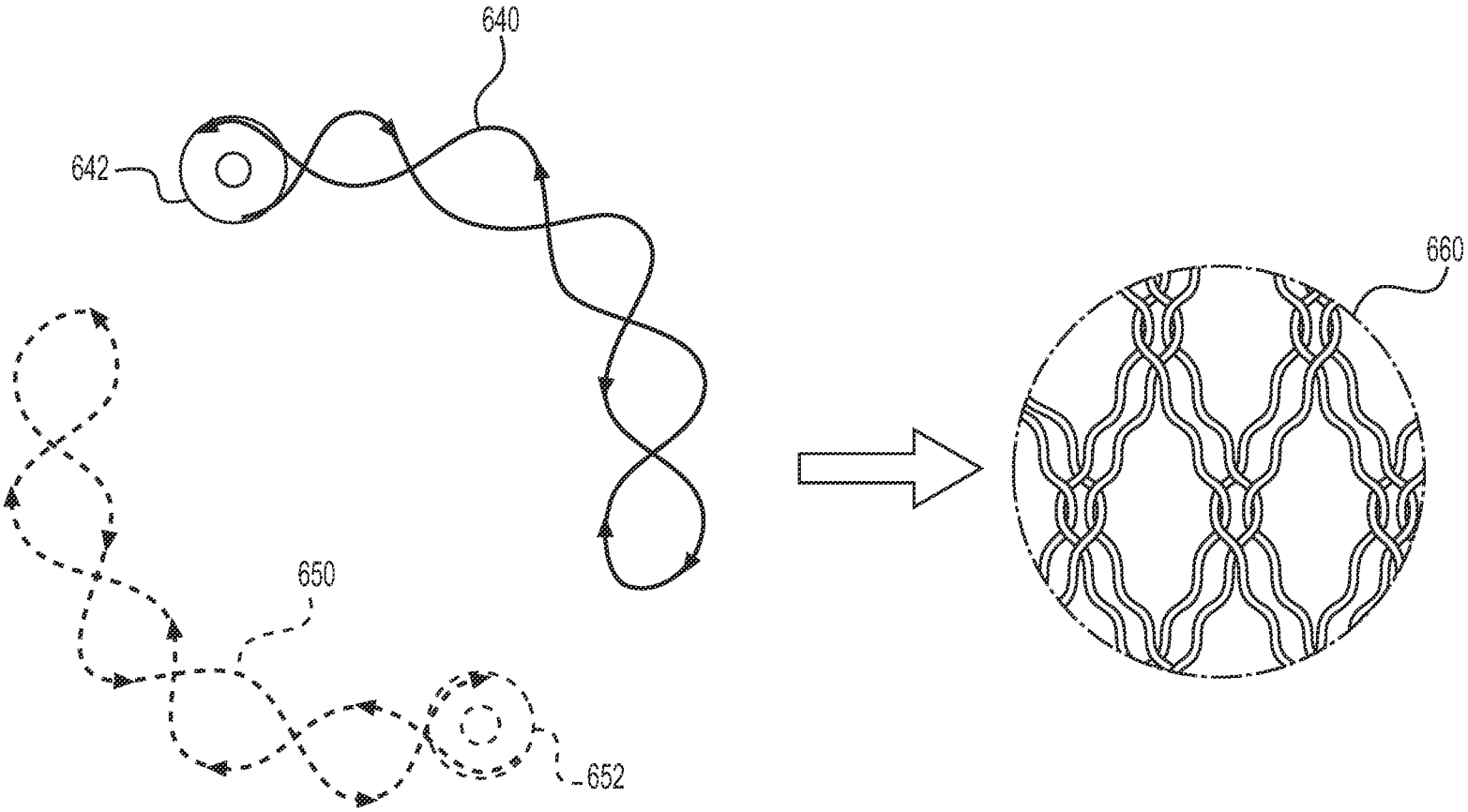
FIG. 12 is a schematic view of a variable spool path configuration for a braiding machine and a corresponding braid pattern.

FIGS. 11-12 illustrate schematic views of various spool paths around a braiding machine and associated braiding patterns. Referring first to FIG. 11, a set of fixed spool paths are shown, including a first fixed spool path 600 for a first spool 602 and a second fixed spool path 610 for a second spool 612. These fixed spool paths are representative of the kinds of fixed paths that spools may take when braid machine 400 is operated to form a non-jacquard braid pattern 630, which is shown schematically in FIG. 11. For purposes of convenience, the combination of first fixed spool path 600 and second fixed spool path 610 may be collectively referred to as a fixed spool path configuration. It may be appreciated that the fixed spool paths shown in FIG. 11 are only intended to be representative of the kinds of fixed paths that spools may take to form non-jacquard braid patterns (e.g., radial braid patterns).

Referring now to FIG. 12, a set of variable spool paths are shown, including a first variable spool path 640 for a first spool 642 and a second variable spool path 650 for a second spool 652. These fixed spool paths are representative of the kinds of variable paths that spools may take when braid machine 400 is operated to form a jacquard braid pattern 660, which is shown schematically in FIG. 12. For purposes of convenience, the combination of first variable spool path 640 and second variable spool path 650 may be collectively referred to as a variable spool path configuration. It may be appreciated that the variable spool paths shown in FIG. 12 are only intended to be representative of the kinds of fixed paths that spools may be used to form jacquard braid patterns (e.g., lace braid patterns).

It may be appreciated that in a fixed spool path configuration, each spool of a braid machine makes a complete loop around the braid machine (either clockwise or counterclockwise in direction) before passing through the same region of the braiding machine. In contrast, in a variable spool path configuration, some spools can pass through a single region two or more times without making a complete loop around the braiding machine.

Some braiding machines (i.e., braiding machine 400) can be operated with spools running in a fixed spool path configuration or a variable spool path configuration, depending on the desired kind of braided pattern to be formed. Moreover, on a machine comprising multiple rings of spools (e.g., braiding machine 400), one ring may operate with a fixed spool path configuration while another ring is simultaneously operated with a variable spool path configuration, in order to simultaneously produce multiple braided layers having different braid patterns.

Figure 13:
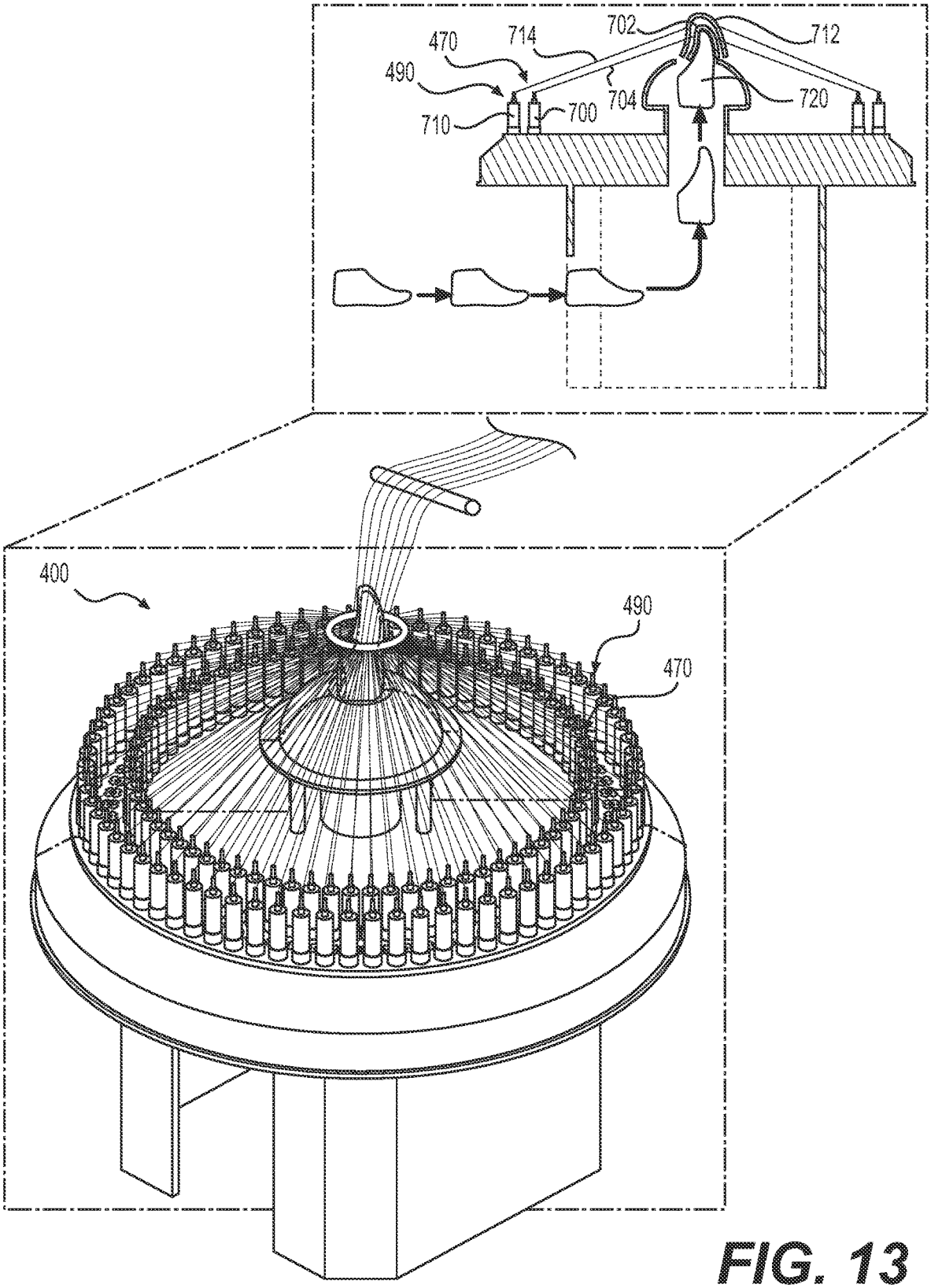
FIG. 13 is a schematic view of an embodiment of a braiding machine illustrating a relationship between rings of spools and layers of a braided upper assembly.

FIG. 13 illustrates an isometric view of an embodiment of braiding machine 400 including a schematic side cross-sectional view of braiding machine 400. FIG. 13 is intended to show how tensile strands from each distinct ring may form a distinct layer of a braided upper assembly, in some operating configurations of machine 400. Referring to FIG. 13, a set of spools 700 moved along inner ring 470 may be used in forming an inner braided structure 702 (i.e., an inner layer), while a set of spools 710 moved along outer ring 490 may be used in forming an outer braided structure 712 (e.g., an outer layer). That is, tensile strands 704 from set of spools 700 may be braided over last 720 to form inner braided structure 702. Also, tensile strands 714 from set of spools 710 may be braided over inner braided structure 702 (and last 720) to form outer braided structure 712. Thus, in at least some operating configurations of braiding machine 400, each ring of the machine may be in one-to-one correspondence with an associated layer of a braided upper assembly. Of course in other operating conditions, including some described below, some spools may be passed between inner ring 470 and outer ring 490, in which case there may not be a clear one-to-one correspondence between each ring and a braid layer in the formed section of the upper assembly.

Figure 14:
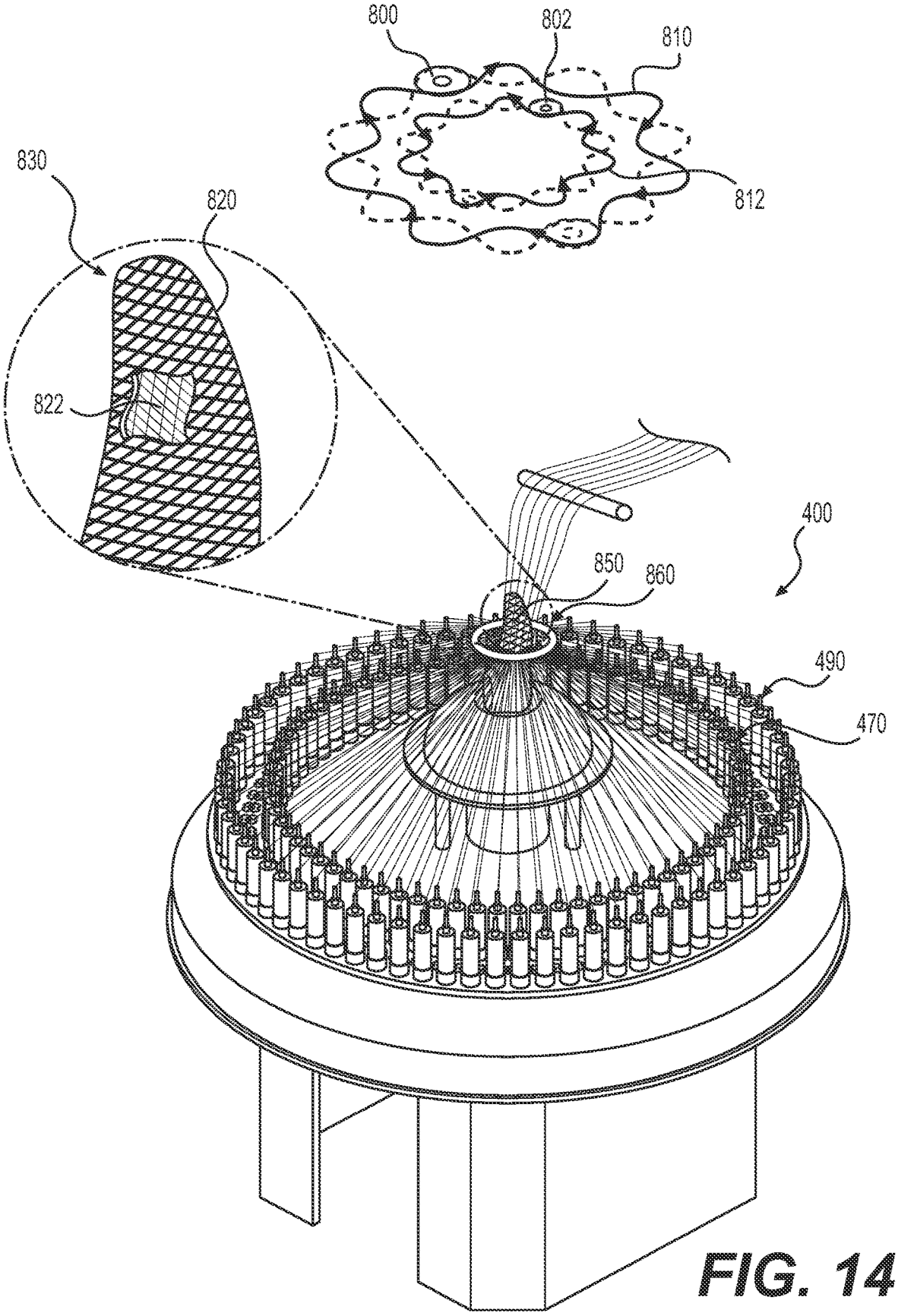
FIGS. 14-17 are schematic views of a step in a process for forming a braided upper assembly comprised of an outer braided structure and an inner braided structure, according to an embodiment.

FIGS. 14-17 illustrate possible steps in a process of forming an upper assembly using braiding machine 400, according to an embodiment. Referring first to FIG. 14, braiding machine 400 is operating such that a set of spools 800 are moved in a fixed spool path configuration 810 along outer ring 490. Likewise, a different set of spools 802 are also moving in a fixed spool path configuration 812 along inner ring 470. The resulting portions of the two corresponding braided structures may also be seen in FIG. 14. Specifically, outer braided structure 820 is formed having a non-jacquard braid pattern along a toe portion 830 of the article being formed. Likewise, inner braided structure 822 is formed having a non-jacquard braid pattern along toe portion 830. Moreover, toe portion 830 is formed as a last 850 is passed through a braiding point 860 of braiding machine 400.

Figure 15:
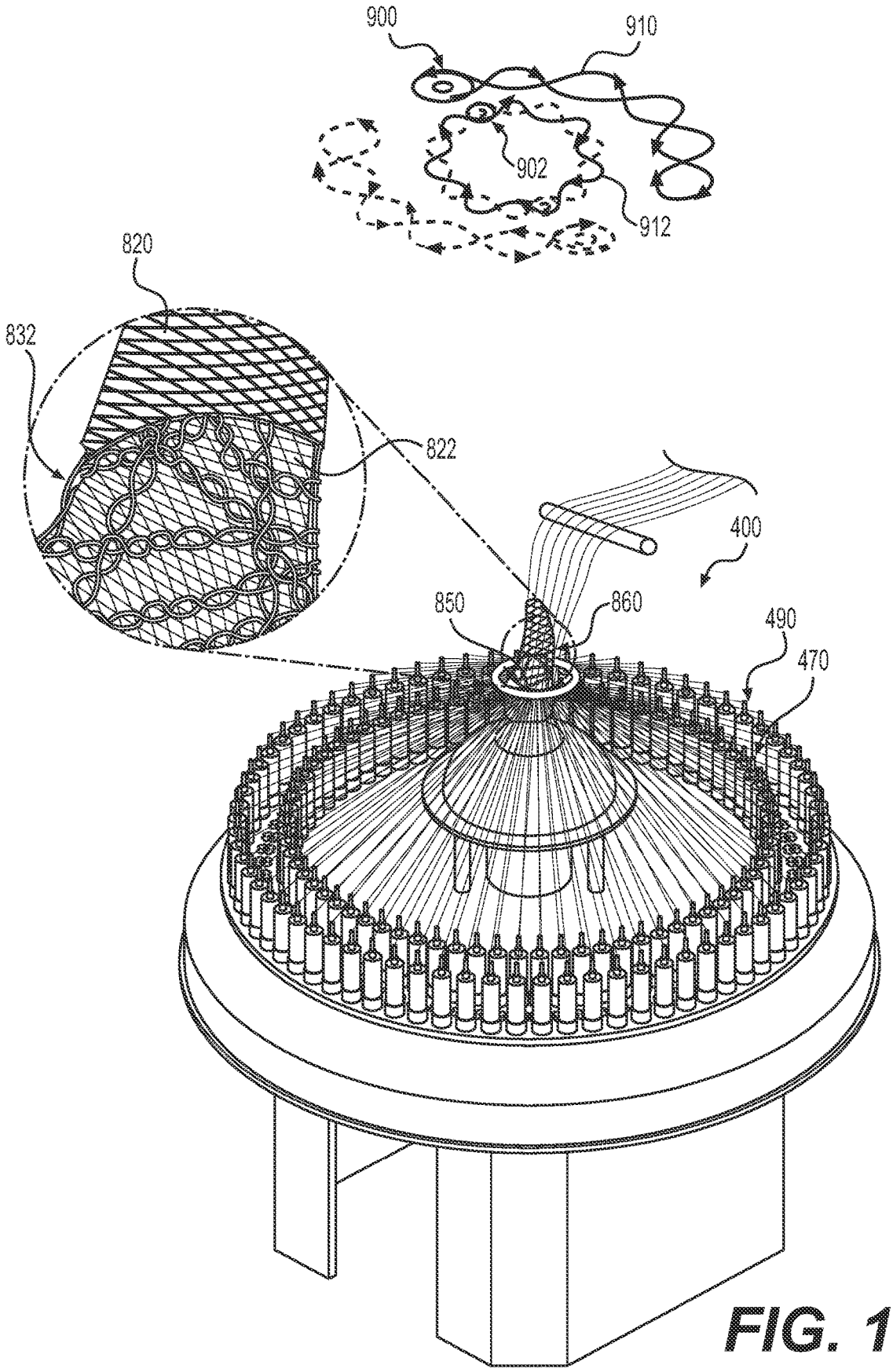

FIG. 15 illustrates a next stage in the formation of a braided upper assembly. As last 850 is passed through braiding point 860 of braiding machine 400, a midfoot portion 832 is formed, which includes portions of both outer braided structure 820 and inner braided structure 822. In this case, a set of spools 900 are moved in a variable spool path configuration 910 along outer ring 490. Additionally, a different set of spools 902 are moved in a fixed spool path configuration 912 along inner ring 470. The resulting portions of the two corresponding braided structures may also be seen in FIG. 15. Specifically, outer braided structure 820 is formed having a jacquard braid pattern along midfoot portion 832. Likewise, inner braided structure 822 is formed having a non-jacquard braid pattern along midfoot portion 832. Thus, it is clear that by moving spools along the outer ring and inner ring in different kinds of paths (variable vs. fixed), different braiding patterns can be simultaneously formed for the two braided structures braided over last 850.

Figure 16:
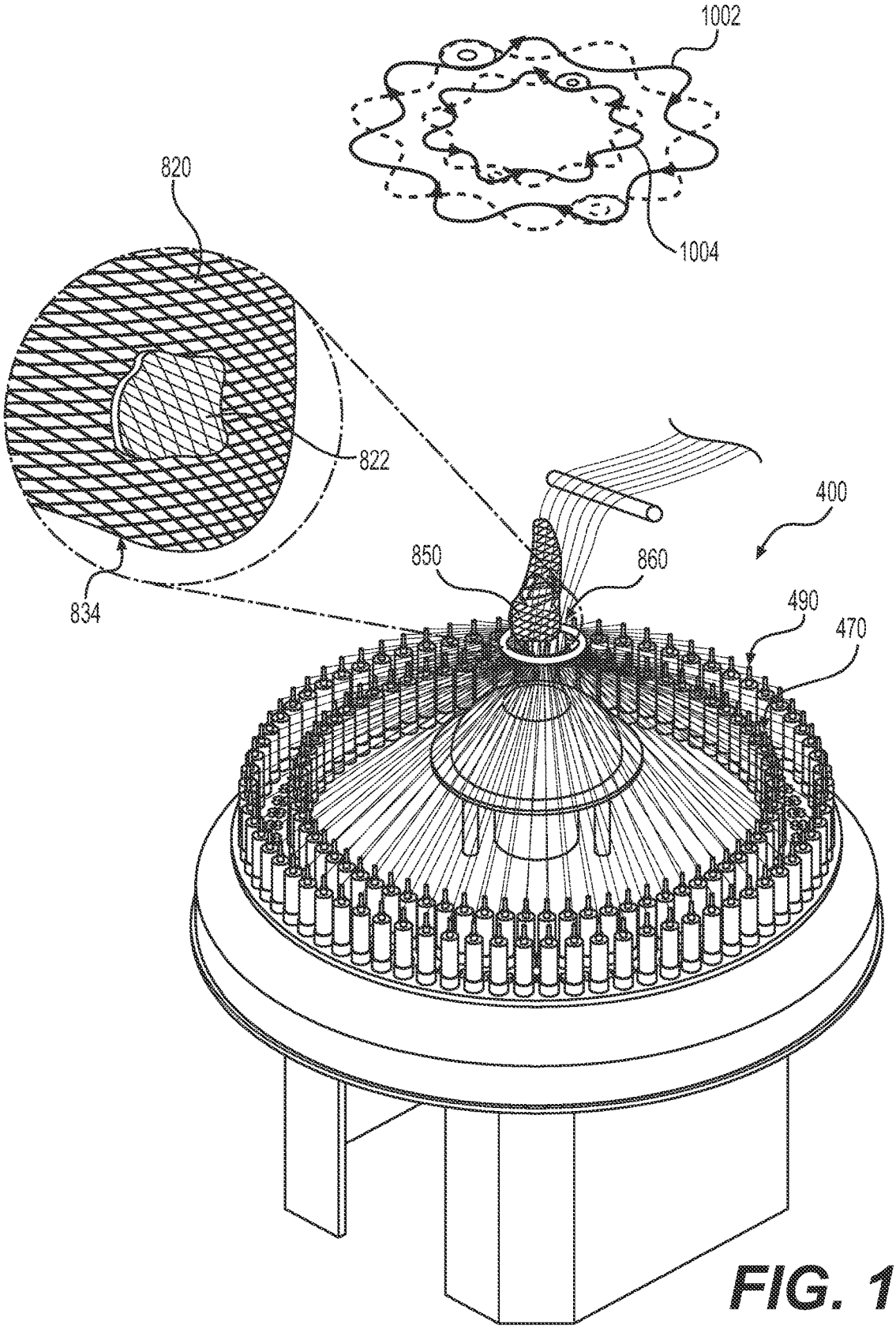

FIG. 16 illustrates a next stage in the formation of a braided upper assembly. As last 850 is passed through braiding point 860 of braiding machine 400, a heel portion 834 is formed, which includes portions of both outer braided structure 820 and inner braided structure 822. In this case, spools along both outer ring 490 and inner ring 470 are moved in a fixed spool path configuration (i.e., a fixed spool path configuration 1002 along outer ring 490 and a variable spool path configuration 1004 along inner ring 470). This allows for the formation of non-jacquard braid patterns in both outer braided structure 820 and inner braided structure 822 over heel portion 834.

Figure 17:
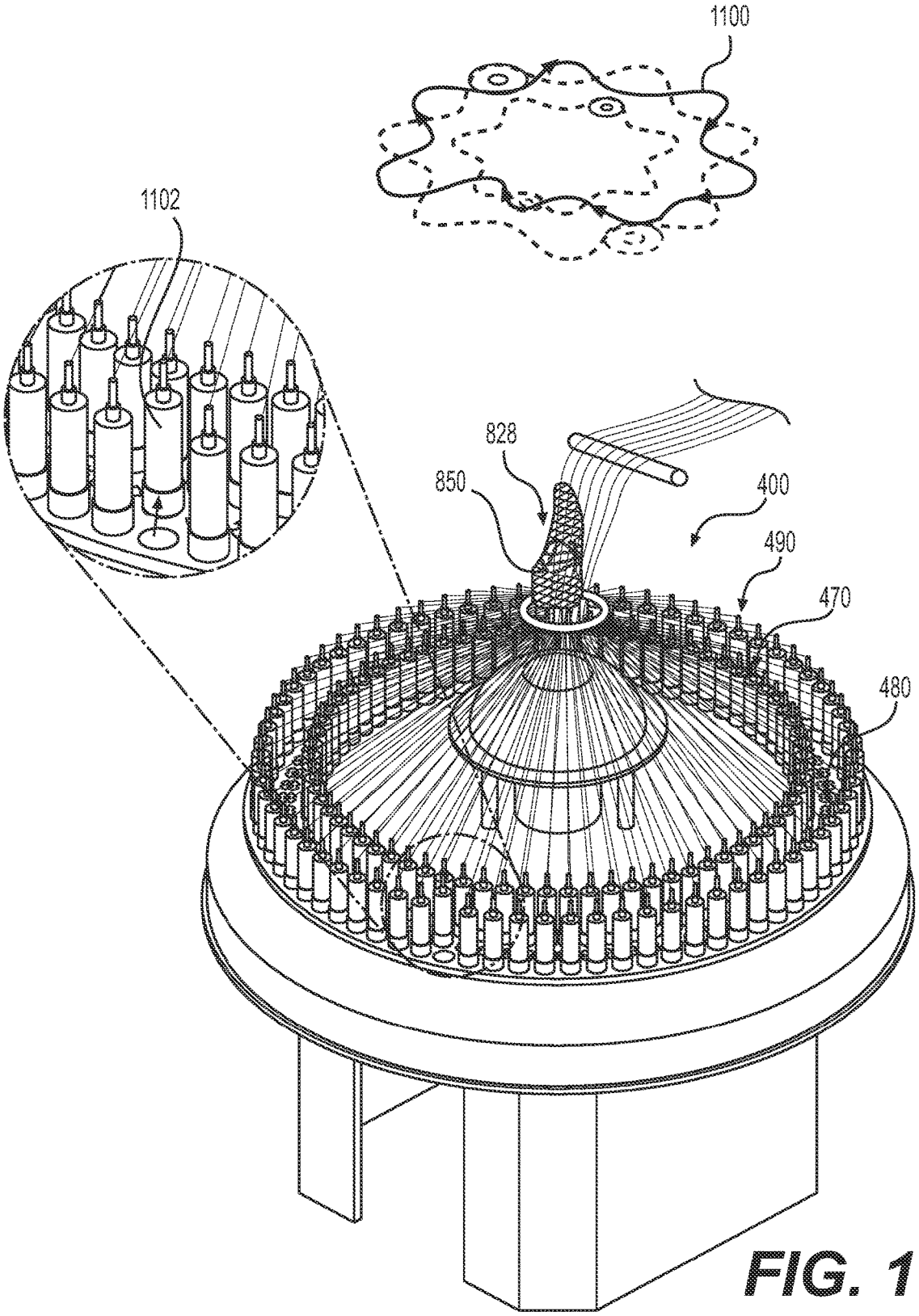

FIG. 17 illustrates an embodiment of an optional step in a process of forming a braided upper assembly, in which it is desirable to attach two braided structures together at some locations. Referring to FIG. 17, in order to intertwine tensile strands of outer braided structure 820 and inner braided structure 822 (see FIGS. 15-16), one or more spools may be passed between outer ring 490 and inner ring 470. For example, as shown in FIG. 17, an exemplary spool path 1100 for one or more spools traverses a portion of outer ring 490, passes across intermediate ring 480 to inner ring 470, and continues traversing along inner ring 470 until eventually passing back to outer ring 490 (via intermediate ring 480). For purposes of illustration FIG. 17 includes an enlarged view of an exemplary spool 1102 being transferred on intermediate ring 480 while passing from outer ring 490 to inner ring 470. It is to be understood that in some cases another spool along inner ring 470 may be subsequently moved to intermediate ring 480 so as to make a space in inner ring 470 for spool 1102. This particular spool path allows one or more strands to be intertwined between outer braided structure 820 and inner braided structure 822, thereby helping to attach the two layers together along at least some portions of upper assembly 828.

As seen in FIGS. 14-16, a single ring of spools (e.g., outer ring 490) can be used to form a jacquard braided pattern and a non-jacquard braided pattern within a single (and continuous) braided structure (e.g., outer braided structure 820). Additional details regarding how the spools may be moved, as well as other operational details, to achieve such a single hybrid braided structure (with both jacquard and non-jacquard, or lace and radial, patterns) can be found in the Hybrid Braided Article application.

Figure 18:
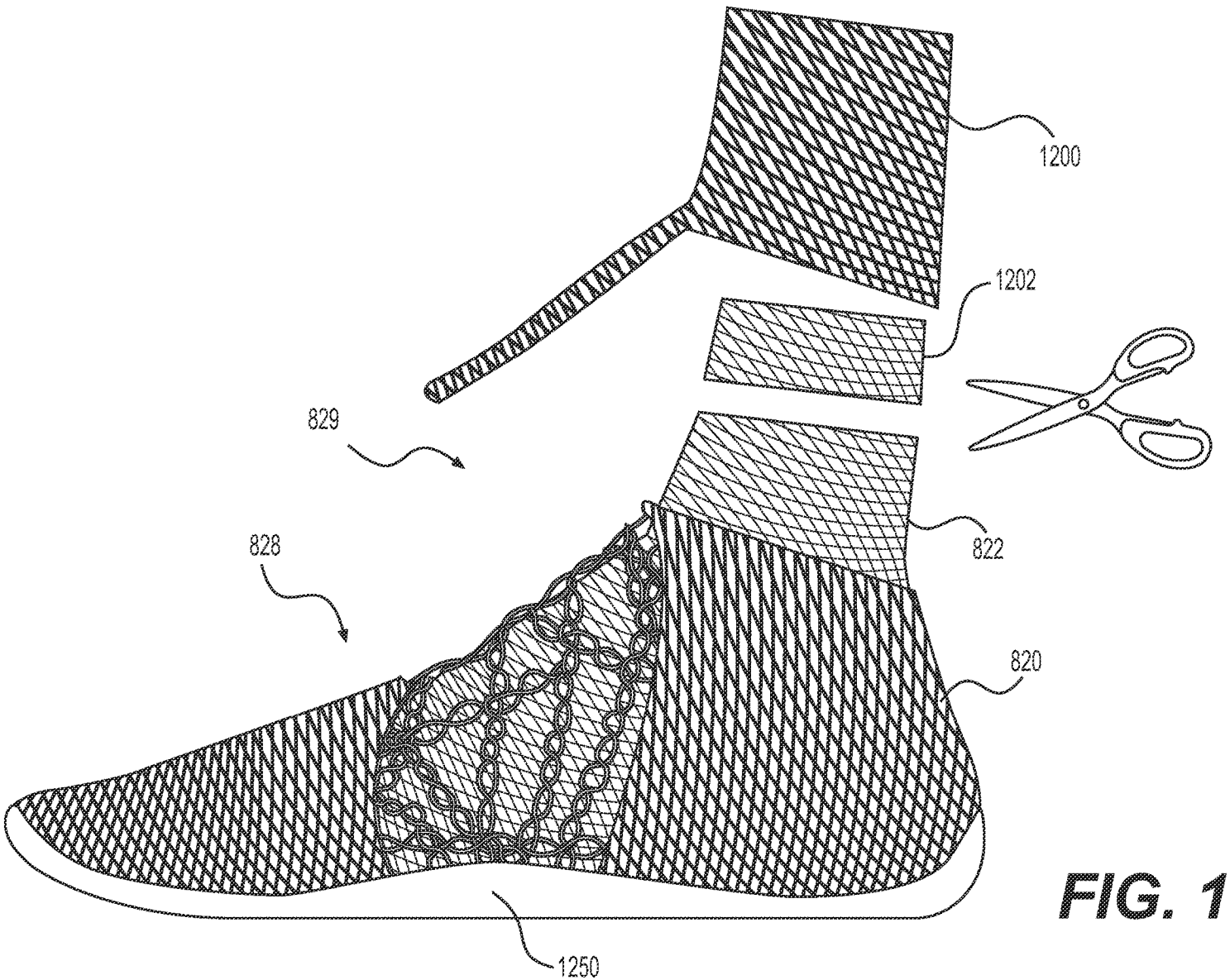
FIG. 18 is a schematic view of a step in forming an article of footwear with a braided upper assembly.

FIG. 18 illustrates additional optional steps in forming an article of footwear 829 having a braided upper assembly, which is comprised of at least an outer and inner braided structure. Referring to FIG. 18, once upper assembly 828 has been removed from braiding machine 400 and last 850, one or more portions could be cut to form openings adjacent a throat of the article. In this case, a first portion 1200 of outer braided structure 820 is cut, which provides an opening for a throat region and includes an opening extending through the instep. Additionally, a second portion 1202 of inner braided structure 822 is cut, which provides access to an interior cavity of upper assembly 828.

In some embodiments, a sole structure could be added to an upper assembly during a step of making an article of footwear. In the exemplary embodiment of FIG. 18, sole structure 1250 is attached to a bottom surface of upper assembly 828. Sole structure 1250 could be attached using any methods known in the art, including but not limited to: adhesives, stitching, fasteners as well as other methods of attachment between a sole structure and a lower surface of a textile, woven or non-woven structure.

In some embodiments, sole structure 1250 may be configured to provide traction for article 829. For example, sole structure 1250 may include one or more traction elements, such as grooves, protrusions, or other traction devices. In one embodiment, sole structure 1250 may include areas with siping along the underside (i.e., the outsole) of sole structure 1250. The siping may comprise thin slits across the surface of the outsole.

In addition to providing traction, sole structure 1250 may attenuate ground reaction forces when compressed between the foot and the ground during walking, running, pushing, or other ambulatory activities. The configuration of sole structure 1250 may vary significantly in different embodiments to include a variety of conventional or non-conventional structures. In some cases, the configuration of sole structure 1250 can be configured according to one or more types of surfaces on which sole structure 1250 may be used. Examples of surfaces include, but are not limited to, natural turf, synthetic turf, dirt, hardwood flooring, skims, wood, plates, footboards, boat ramps, as well as other surfaces.

Sole structure 1250 is secured to upper assembly 828 and extends between the foot and the ground when article 829 is worn. In different embodiments, sole structure 1250 may include different components. For example, sole structure 1250 may include an outsole, a midsole, and/or an insole. In some cases, one or more of these components may be optional.

While the embodiments depict manufacturing a braided upper assembly using a braiding machine having a horizontal configuration, and using a moving last system, other embodiments could include machines having vertical configurations and/or fixed last systems. In particular, embodiments could use any of the methods and braiding machine configurations as disclosed in the Multi-Ring Braiding Machine application. For example, in other embodiments, a vertical braiding machine with a moving last system could be used to form a braided upper assembly.

FIGS. 19-24 illustrate views of various alternative embodiments of a braided upper assembly incorporating at least two layers of braided structures.

Figure 19:
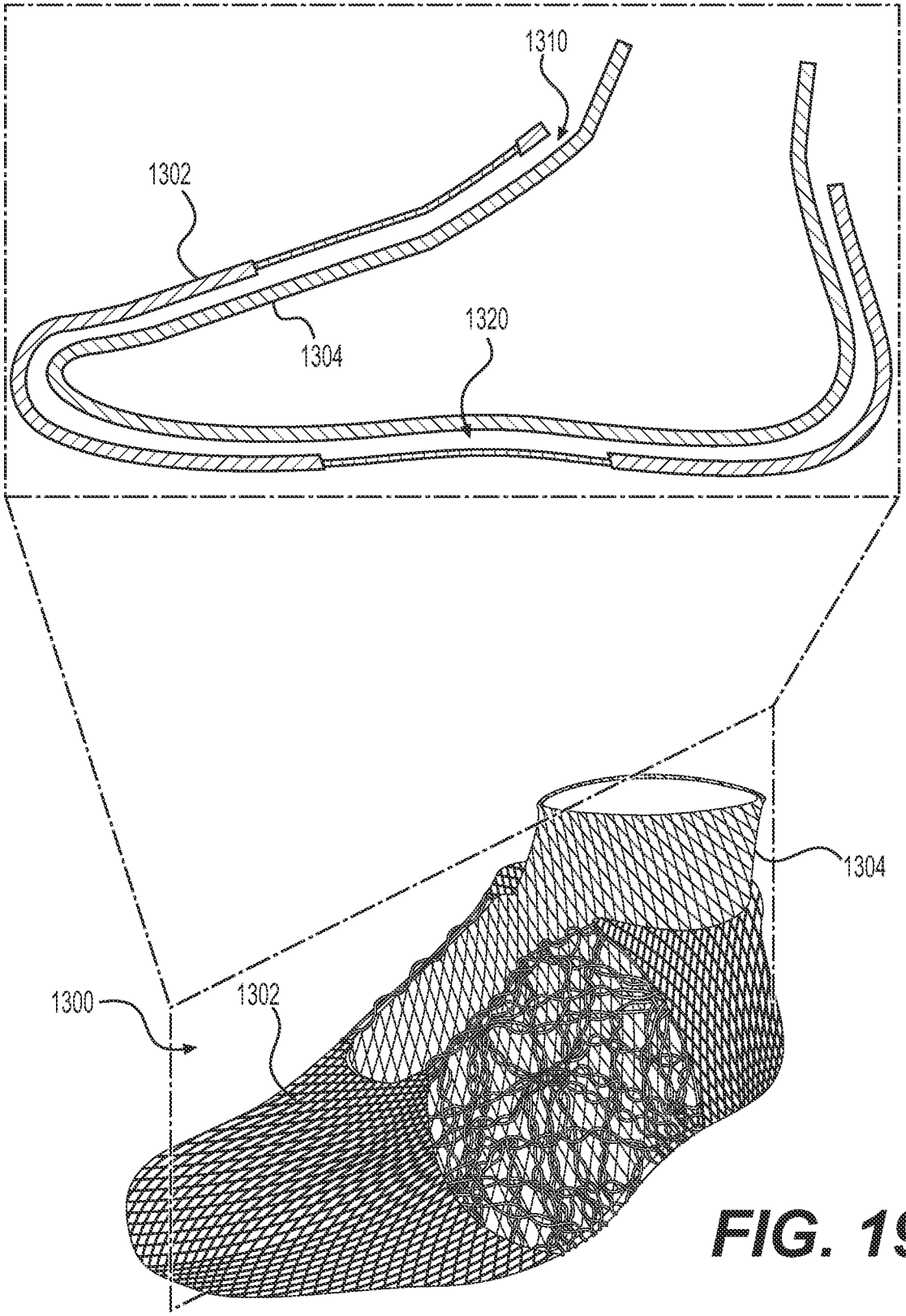
FIG. 19 is a schematic view of an embodiment of a braided upper assembly including a schematic cross sectional view.

FIG. 19 illustrates an embodiment for an upper assembly 1300. Upper assembly 1300 may include an outer braided structure 1302 and an inner braided structure 1304. In contrast to the previous embodiment, outer braided structure 1302 and inner braided structure 1304 may not be attached to one another via intertwined tensile strands or other attachment provisions. Instead, inner braided structure 1304 may sit freely within outer braided structure 1302 such that, in some cases, inner braided structure 1304 could be removed from outer braided structure 1302 through an opening 1310 in outer braided structure 1302. For purposes of illustration, a small gap 1320 is shown between outer braided structure 1302 and inner braided structure 1304 to emphasize that these layers may not be attached and may even be capable of some relative movement during use. Embodiments with detached layers may facilitate the use of interchangeable inner braided layers, and may also allow for the insertion of various pads, cushions or similar provisions at some locations between two braided layers (e.g., placing a cushion at a foot bed between an outer braided structure and an inner braided structure to improve cushioning).

Figure 20:
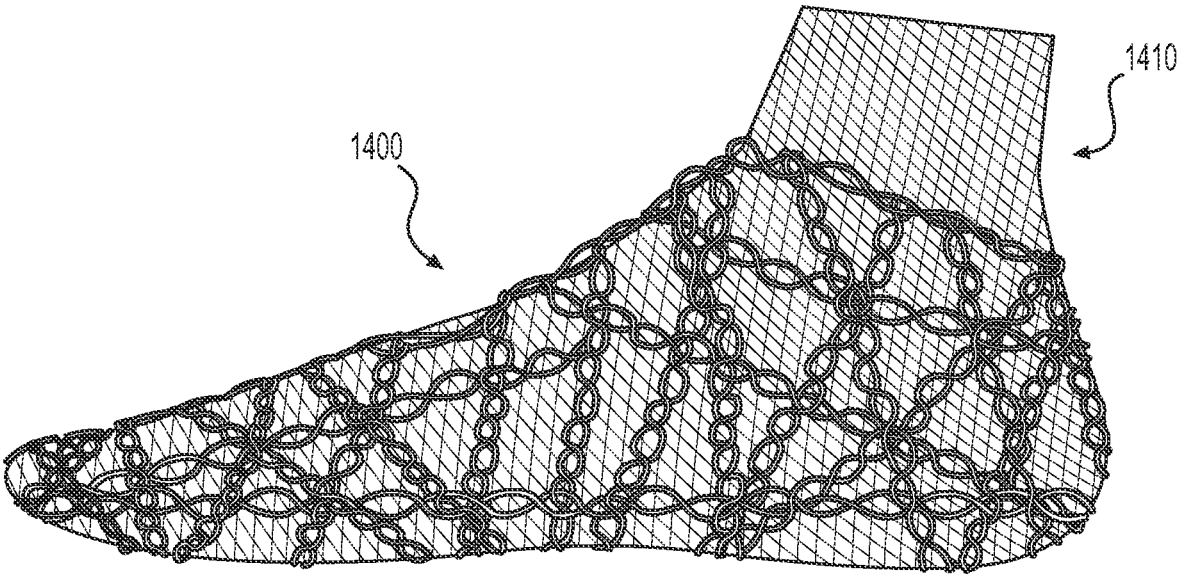
FIG. 20 is a schematic side view of an embodiment of a braided upper assembly with an outer braided structure having a jacquard braid pattern and an inner braided structure having a non-jacquard braid pattern.

FIG. 20 illustrates alternative embodiments utilizing a variety of different combinations of braid patterns along the outer and inner braided structures. In an embodiment depicted in FIG. 20, an outer braided structure 1400 may be entirely comprised of a jacquard braid pattern, while an inner braided structure 1410 may be entirely comprised of a non-jacquard braid pattern. This embodiment may provide a highly decorative outer layer (i.e., a lace braided structure) with a more durable inner layer (i.e., a non-jacquard or radial braided layer) that may also provide more coverage than the outer layer.

Figure 21:
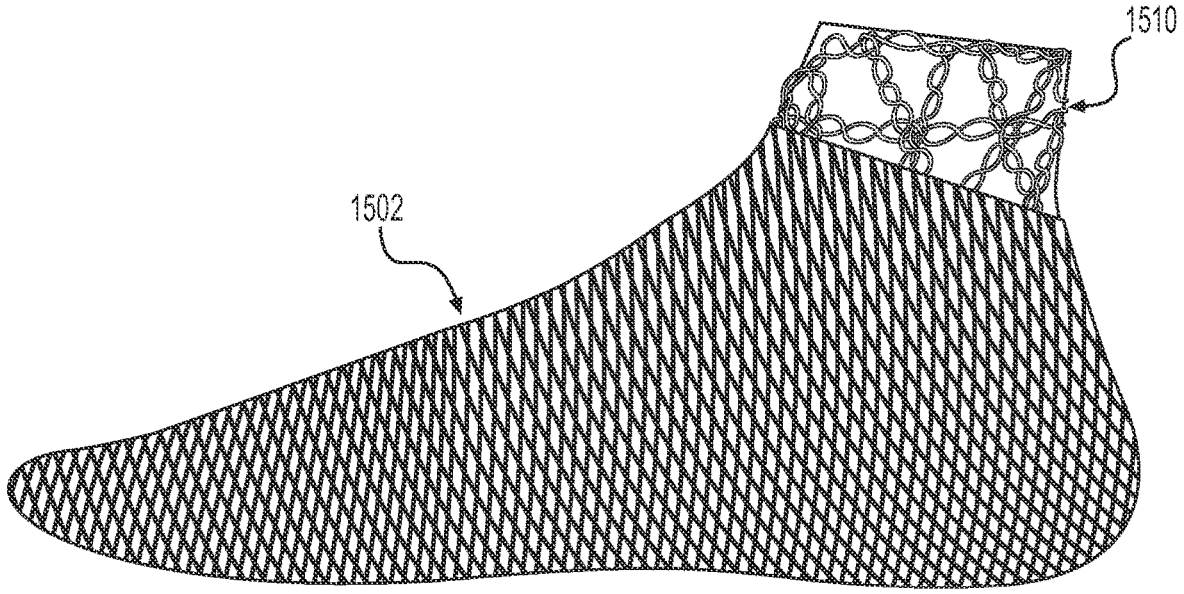
FIGS. 21-22 illustrate side schematic views of an embodiment of a braided upper assembly with an outer braided structure having a non-jacquard braid pattern and an inner braided structure having a jacquard braid pattern.
Figure 22:
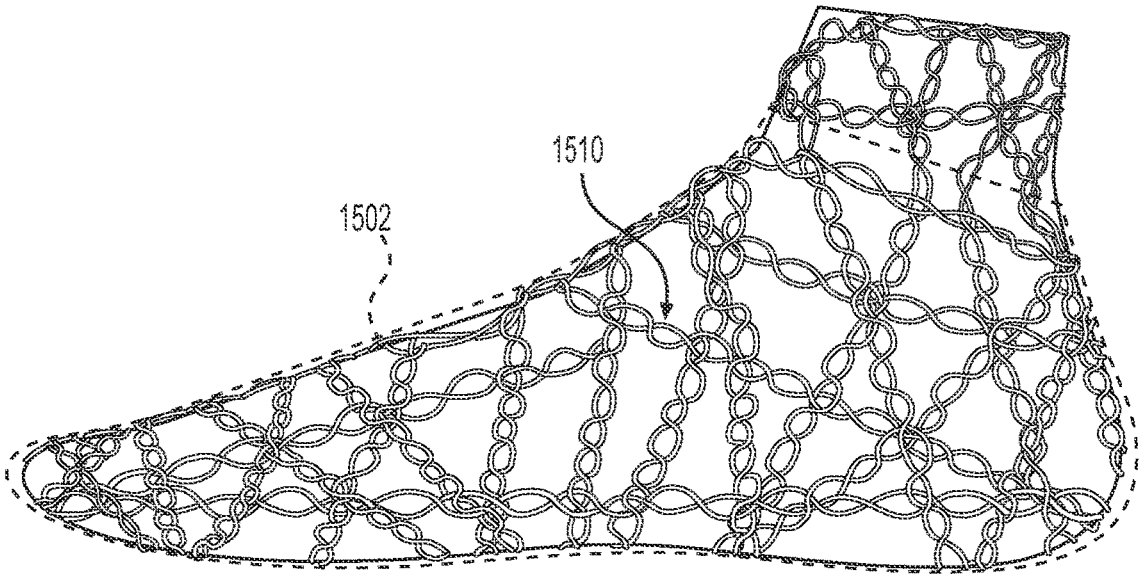

In another embodiment shown in FIGS. 21-22, an outer braided structure 1500 may be entirely comprised of a non-jacquard braid pattern 1502, while an inner braided structure 1510 (clearly visible in FIG. 22) may be entirely comprised of a jacquard braid pattern.

Figure 23:
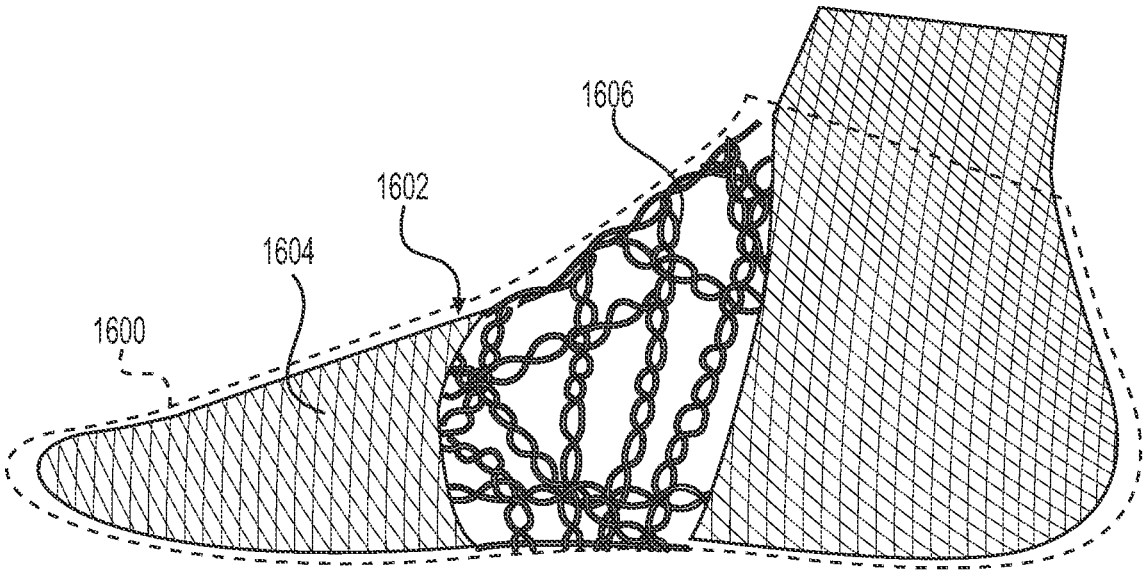
FIG. 23 is a schematic side view of an embodiment of a braided upper assembly where an inner braided structure has at least two different braid patterns.

In yet another embodiment shown in FIG. 23, an inner braided structure 1602 may be comprised of multiple different braid patterns, similar to the multiple braid patterns used in the outer braided structure of the embodiments shown in FIGS. 1-3. Specifically, inner braided structure 1602 may include a non-jacquard braid pattern 1604 in the heel and forefoot portions, as well as a jacquard braid pattern 1606 in the midfoot portion. In some embodiments, an outer braided structure 1600 (shown in phantom) may comprise a similar combination of braid patterns (i.e., may be similar to outer braided structure 120 of FIGS. 1-2). This combination of outer braided structure 1600 and inner braided structure 1602 may provide an article with a great deal of durability in the forefoot and heel, and with high flexibility and breathability in the midfoot.

While the embodiments of the figures depict articles having low collars (e.g., low-top configurations), other embodiments could have other configurations. In particular, the methods and systems described herein may be utilized to make a variety of different article configurations, including articles with higher cuff or ankle portions. For example, in another embodiment, the systems and methods discussed herein can be used to form a braided upper with a cuff that extends up a wearer's leg (i.e., above the ankle). In another embodiment, the systems and methods discussed herein can be used to form a braided upper with a cuff that extends to the knee. In still another embodiment, the systems and methods discussed herein can be used to form a braided upper with a cuff that extends above the knee. Thus, such provisions may allow for the manufacturing of boots comprised of braided structures. In some cases, articles with long cuffs could be formed by using lasts with long cuff portions (or leg portions) with a braiding machine (e.g., by using a boot last). In such cases, the last could be rotated as it is moved relative to a braiding point so that a generally round and narrow cross-section of the last is always presented at the braiding point.

While various embodiments have been described, the description is intended to be exemplary, rather than limiting, and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

What is claimed is:

1. A braided upper assembly for a braided article of footwear, comprising:

an inner braided structure having a first braid pattern formed from a first plurality of intertwined tensile strands, the inner braided structure forming an inner braided layer of the braided upper, wherein an inner forefoot portion of the inner braided layer is continuously braided with an inner midfoot portion of the inner braided layer, and wherein the inner midfoot portion is continuously braided with an inner heel portion of the inner braided layer; and an outer braided structure having a second braid pattern formed from a second plurality of intertwined tensile strands, the outer braided structure forming an outer braided layer of the braided upper, wherein an outer forefoot portion of the outer braided layer is continuously braided with an outer midfoot portion of the outer braided layer, and wherein the outer midfoot portion is continuously braided with an outer heel portion of the outer braided layer;

wherein the outer braided layer envelops the inner braided layer such that the inner forefoot portion overlaps with the outer forefoot portion, the inner midfoot portion overlaps with the outer midfoot portion, and the inner heel portion overlaps with the outer heel portion, and wherein the inner braided layer is secured to the outer braided layer by engaging two or more tensile strands from the first plurality of intertwined tensile strands of the inner midfoot portion of the inner braided layer with two or more tensile strands from the second plurality of intertwined tensile strands of the outer midfoot portion of the outer braided layer.

2. The braided upper assembly according to claim 1, wherein the outer forefoot portion of the outer braided layer includes a non-jacquard braid pattern, wherein the outer midfoot portion of the outer braided layer includes a jacquard braid pattern, and wherein the outer heel portion of the outer braided layer includes the non-jacquard braid pattern.

3. The braided upper assembly according to claim 2, wherein the inner forefoot portion of the inner braided layer, the inner midfoot portion of the inner braided layer, and the inner heel portion of the inner braided layer include the non-jacquard braid pattern.

4. The braided upper assembly according to claim 2, wherein spacing between adjacent tensile strands in the first plurality of intertwined tensile strands and the second plurality of intertwined tensile strands forming the jacquard braid pattern form openings having non-uniform opening sizes and wherein the spacing between adjacent tensile strands in the first plurality of intertwined tensile strands and the second plurality of intertwined tensile strands forming the non-jacquard braid pattern varies in a uniform manner forming openings having uniform opening sizes.

5. The braided upper assembly according to claim 2, wherein a density of the non-jacquard braid pattern is substantially constant along every direction of the outer braided layer.

6. A braided article of footwear, comprising:

a braided upper assembly comprised of:

an outer braided structure forming an outer braided layer formed from a first plurality of intertwined tensile strands and comprising an outer forefoot portion, an outer midfoot portion, and an outer heel portion, wherein the outer forefoot portion is continuous with the outer midfoot portion, and wherein the outer midfoot portion is continuous with the outer heel portion; and an inner braided structure forming an inner braided layer formed from a second plurality of intertwined tensile strands and comprising an inner forefoot portion, an inner midfoot portion, and an inner heel portion, wherein the inner forefoot portion is continuous with the inner midfoot portion, and wherein the inner midfoot portion is continuous with the inner heel portion, wherein the inner braided layer is attached to the outer braided layer by engaging two or more tensile strands from the first plurality of intertwined tensile strands of the outer braided layer with two or more tensile strands from the second plurality of intertwined tensile strands of the inner braided layer at one or more locations, wherein the outer forefoot portion overlaps with the inner forefoot portion, wherein the outer midfoot portion overlaps with the inner midfoot portion, and wherein the outer heel portion overlaps with the inner heel portion when the inner braided layer is disposed within the outer braided layer; and a sole structure, wherein the outer braided structure layer has a first opening and the inner braided layer has a second opening, and wherein a collar portion of the inner braided structure layer extends through the first opening of the outer braided layer, and wherein the sole structure is disposed against the outer braided layer.

7. The braided article of footwear according to claim 6, wherein the first plurality of intertwined tensile strands forming the outer braided layer form a first braid pattern, wherein a portion of the first braid pattern of the outer braided layer includes a jacquard braid pattern.

8. The braided article of footwear according to claim 7, wherein the second plurality of intertwined tensile strands forming the inner braided layer form a second braid pattern, wherein a portion of the second braid pattern of the inner braided layer includes a non-jacquard braid pattern, and wherein the portion of first braid pattern of the outer braided layer having the jacquard braid pattern is in contact with the portion of the second braid pattern of the inner braided layer having the non-jacquard braid pattern.

9. The braided article of footwear according to claim 8, wherein the first braid pattern of the outer braided layer includes a second portion having the non-jacquard braid pattern.

10. The braided article of footwear according to claim 6, wherein the outer braided structure layer has a non-jacquard braid pattern at an outer toe portion of the braided upper assembly and wherein the inner braided layer has the non-jacquard braid pattern at an inner toe portion of the braided upper assembly.

11. The braided article of footwear according to claim 8, wherein the portion of the first braid pattern of the outer braided layer having the jacquard braid pattern is located at the outer midfoot portion of the outer braided structure and wherein the inner midfoot portion of the inner braided structure of the inner braided layer also includes the jacquard braid pattern.

12. The braided article of footwear according to claim 6, wherein the outer heel portion of the outer braided layer includes a non-jacquard braid pattern, and wherein the inner heel portion of the inner braided layer also includes the non-jacquard braid pattern.

13. The braided upper assembly according to claim 1, wherein the first braid pattern of a portion of the inner braided layer includes a non-jacquard braid pattern, and wherein the second braid pattern of a portion of the outer braided layer includes a jacquard braid pattern.

14. The braided upper assembly according to claim 2, wherein a spacing between adjacent tensile strands in the second plurality of intertwined tensile strands forming the jacquard braid pattern varies in non-uniform manner such that a second density of the second plurality of intertwined tensile strands forming the jacquard braid pattern is variable in multiple directions of the outer braided layer.

15. The braided upper assembly according to claim 13, wherein the portion of the outer braided layer including the jacquard braid pattern is located at the outer midfoot portion of the outer braided layer.

* * * * *